US007172476B2

(12) United States Patent
Nakamura et al.

(10) Patent No.: US 7,172,476 B2
(45) Date of Patent: Feb. 6, 2007

(54) OUTBOARD MOTOR WITH BRACKET ASSEMBLY

(75) Inventors: Daisuke Nakamura, Shizuoka-ken (JP); Isao Fujii, Shizuoka-ken (JP); Masayuki Arito, Shizuoka-ken (JP); Takashi Okajima, Shizuoka-ken (JP); Masayosi Sawamura, Shizuoka-ken (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

(21) Appl. No.: 11/124,606

(22) Filed: May 6, 2005

(65) Prior Publication Data

US 2005/0250394 A1 Nov. 10, 2005

(30) Foreign Application Priority Data

| | | |
|---|---|---|
| May 7, 2004 | (JP) | 2004-138973 |
| May 7, 2004 | (JP) | 2004-138974 |
| May 10, 2004 | (JP) | 2004-140226 |
| May 20, 2004 | (JP) | 2004-150546 |
| May 20, 2004 | (JP) | 2004-150547 |
| May 20, 2004 | (JP) | 2004-150548 |

(51) Int. Cl.
*B63H 5/125* (2006.01)

(52) U.S. Cl. ..... 440/61 T

(58) Field of Classification Search ..... 440/61 T
See application file for complete search history.

(56) References Cited

U.S. PATENT DOCUMENTS

| | | | | |
|---|---|---|---|---|
| 4,368,074 | A * | 1/1983 | Otto et al. | 419/51 |
| 6,183,320 | B1 * | 2/2001 | Natsume | 440/53 |
| 2003/0041993 | A1 * | 3/2003 | Kuramasu et al. | 164/66.1 |

FOREIGN PATENT DOCUMENTS

| | | |
|---|---|---|
| JP | 56-26497 | 6/1981 |
| JP | 1-10320 | 3/1989 |
| JP | 6-35276 | 5/1994 |
| JP | 11-245892 | 9/1999 |
| JP | 11-310194 | 11/1999 |
| JP | 2000-289691 | 10/2000 |
| JP | 2003-341579 | 3/2003 |
| JP | 2003-237659 | 8/2003 |
| JP | 2003-237667 | 8/2003 |
| JP | 2004-106571 | 4/2004 |

* cited by examiner

*Primary Examiner*—Stephen Avila
(74) *Attorney, Agent, or Firm*—Knobbe, Martens, Olson & Bear, LLP

(57) ABSTRACT

An outboard motor includes a drive unit and a bracket assembly mounting the drive unit on an associated watercraft. The bracket assembly includes a swivel bracket that carries the drive unit for pivotal movement about a steering axis that extends generally vertically, and a clamping bracket that supports the swivel bracket and the drive unit for pivotal movement about a tilt axis that extends generally horizontally. Either the swivel bracket or the clamping bracket, at least in part, has a first flange, a second flange spaced apart from the first flange, and a web that extends between the first and second flanges to connect together the first and second flanges. The first and second flanges extend generally parallel to the tilt axis. The web extend generally normal to the tilt axis.

30 Claims, 32 Drawing Sheets

OUTBOARD MOTOR WITH BRACKET ASSEMBLY

PRIORITY INFORMATION

This application is based on and claims priority under 35 U.S.C. § 119 to Japanese Patent Applications No. 2004-138973, filed on May 7, 2004, No. 2004-138974, filed on May 7, 2004, No. 2004-140226, filed on May 10, 2004, No. 2004-150546, filed on May 20, 2004, No. 2004-150547, filed on May 20, 2004, and No. 2004-150548, filed on May 20, 2004, the entire contents of which are hereby expressly incorporated by reference.

BACKGROUND

1. Field of the Art

The present invention generally relates to an outboard motor with a bracket assembly, and more particularly relates to an outboard motor that has a bracket assembly to mount a drive unit of the outboard motor on an associated watercraft.

2. Description of Related Art

Typically, outboard motors incorporate a bracket assembly to mount a drive unit thereof on a transom of an associated watercraft. The bracket assembly typically includes a swivel bracket carrying the drive unit for pivotal movement about a steering axis that extends generally vertically, and a clamping bracket supporting the swivel bracket and the drive unit for pivotal movement about a tilt axis extending generally horizontally. The drive unit usually has a propeller in a lower portion thereof to generate propulsion force. Typically, an engine disposed in an upper portion of the drive unit provides power to rotate the propeller through a drive mechanism disposed within the drive unit. For example, Japanese Patent Publication Nos. JP11-310194A and JP2000-289691A disclose such outboard motors.

The lower portion of the drive unit is submerged under water while the propeller propels the associated watercraft. Under the circumstances, a floating object such as, for example, a piece of driftwood can strike the lower portion of the drive unit, or the drive unit can run into a rock under the water while the watercraft travels through in shallow water. A relatively large impact load is exerted on the bracket assembly in those situations. Even though such a load is not exerted, the bracket assembly always receives thrust from the propeller whenever the propeller propels the associated watercraft. The bracket assembly thus is required to endure the various loads or force exerted thereon. More specifically, the swivel bracket and the clamping bracket need to have sufficient rigidity or strength to endure those loads or force.

The thicknesses of the portions of the swivel and clamping brackets which are most subject to such loadings, conventionally are increased to provide the necessary rigidity, and the thickness of the remainder portions thereof are dictated by the thickness of the former portions. In addition, the swivel and clamping brackets are usually produced in a low pressure casting process. Such a method requires the thickness to be relatively large and also requires the entire configuration of the swivel bracket and the clamping bracket to be as simple as possible. Thus, the swivel and clamping brackets are likely to have excessive thickness beyond what is required for rigidity or strength considerations. The entire bracket assembly thus tends to be heavy and cumbersome.

SUMMARY OF THE INVENTION

An aspect of the present invention involves the recognition of the need for a bracket assembly of an outboard motor that can be light and compact while having the necessary rigidity or strength.

To address such a need, an aspect of the present invention involves an outboard motor comprising a drive unit and a bracket assembly adapted to mount the drive unit on an associated watercraft. The bracket assembly comprises a swivel bracket carrying the drive unit for pivotal movement about a steering axis that extends generally vertically, and a clamping bracket supporting the swivel bracket and the drive unit for pivotal movement about a tilt axis that extends generally horizontally. Either the swivel bracket or the clamping bracket, at least in part, comprises a first flange, a second flange spaced apart from the first flange, and a web extending between the first and second flanges to connect together the first and second flanges. The first and second flanges extend generally parallel to the tilt axis. The web extends generally normal to the tilt axis.

In accordance with another aspect of the present invention, a method is provided for producing a swivel bracket or a clamping bracket of an outboard motor including a first flange and a second flange spaced apart from each other and a web extending between the first and second flanges. The method comprises placing first and second dies to define a cavity therebetween that corresponds to the shape of at least a portion of one of the swivel and clamping brackets, and introducing molten metal into the cavity under a negative pressure.

BRIEF DESCRIPTION OF THE DRAWINGS

These and other features, aspects and advantages of the present invention are now described with reference to the drawings of a preferred embodiment, which is intended to illustrate and not to limit the present invention. The drawings comprise 43 figures in which.

DETAILED DESCRIPTION OF A PREFERRED EMBODIMENT OF THE PRESENT INVENTION

Figure 1:
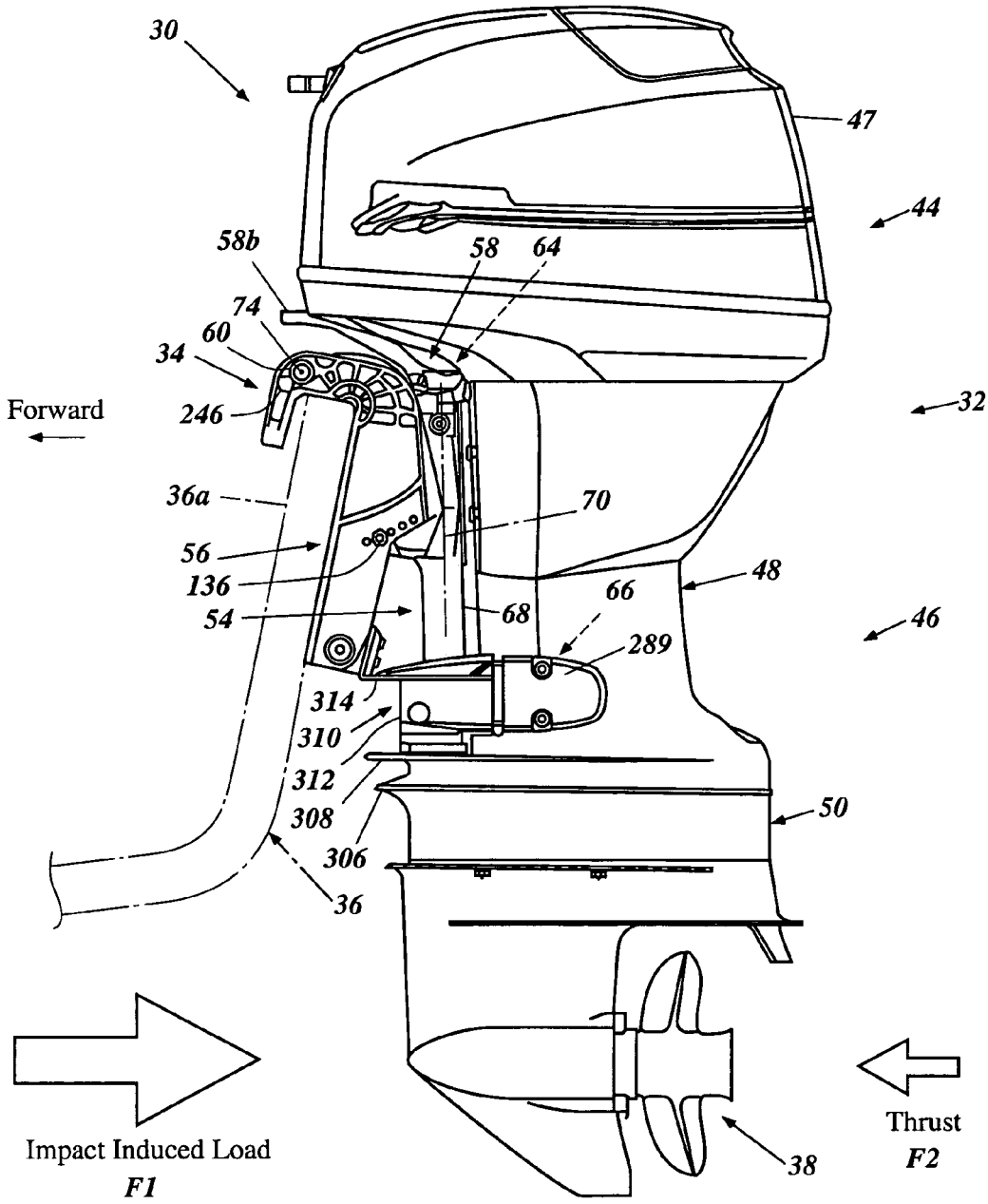
FIG. 1 illustrates a side elevation view of an outboard motor arranged and configured in accordance with certain features, aspects and advantages of the present invention, with a transom of an associated watercraft shown in phantom.

With reference to FIG. 1, an overall configuration of an outboard motor 30 that can be used with various features, aspects and advantages of the present invention is described.

The outboard motor 30 preferably comprises a drive unit 32 and a bracket assembly 34. The bracket assembly 34 supports the drive unit 32 on a transom 36*a* of an associated watercraft 36 and places a marine propulsion device such as, for example, a propeller 38, in a submerged position with the watercraft 36 resting relative to a surface of a body of water. The drive unit 32 can be tilted up or down relative to the watercraft 36 by a hydraulic tilt and trim adjustment device 40 (FIGS. 2, 14 and 20) combined with the bracket assembly 34.

As used through this description, the terms "rear" and "rearward" mean at or to the side where the propeller 38 is located, unless indicated otherwise or otherwise readily apparent from the context used. The terms "forward" and "front" mean at or to the opposite side of the rear side, unless indicated otherwise or otherwise readily apparent from the context used.

Also, as used in this description, the term "horizontally" means that the subject portions, members or components extend generally in parallel to the water surface when the watercraft 36 is substantially stationary with respect to the water surface and when the drive unit 32 is not tilted and is generally placed in the position shown in FIG. 1. The term "vertically" in turn means that portions, members or components extend generally normal to those that extend horizontally.

The drive unit 32 preferably comprises a power head 44 and a housing unit 46. The power head 44 is disposed atop the drive unit 32 and includes an internal combustion engine. In order to protect the engine, the power head 44 also includes a protective cowling assembly 47 that surrounds the engine. The engine generates the power for driving the propeller 38. The engine has a crankshaft preferably extending generally vertically.

Figure 20:
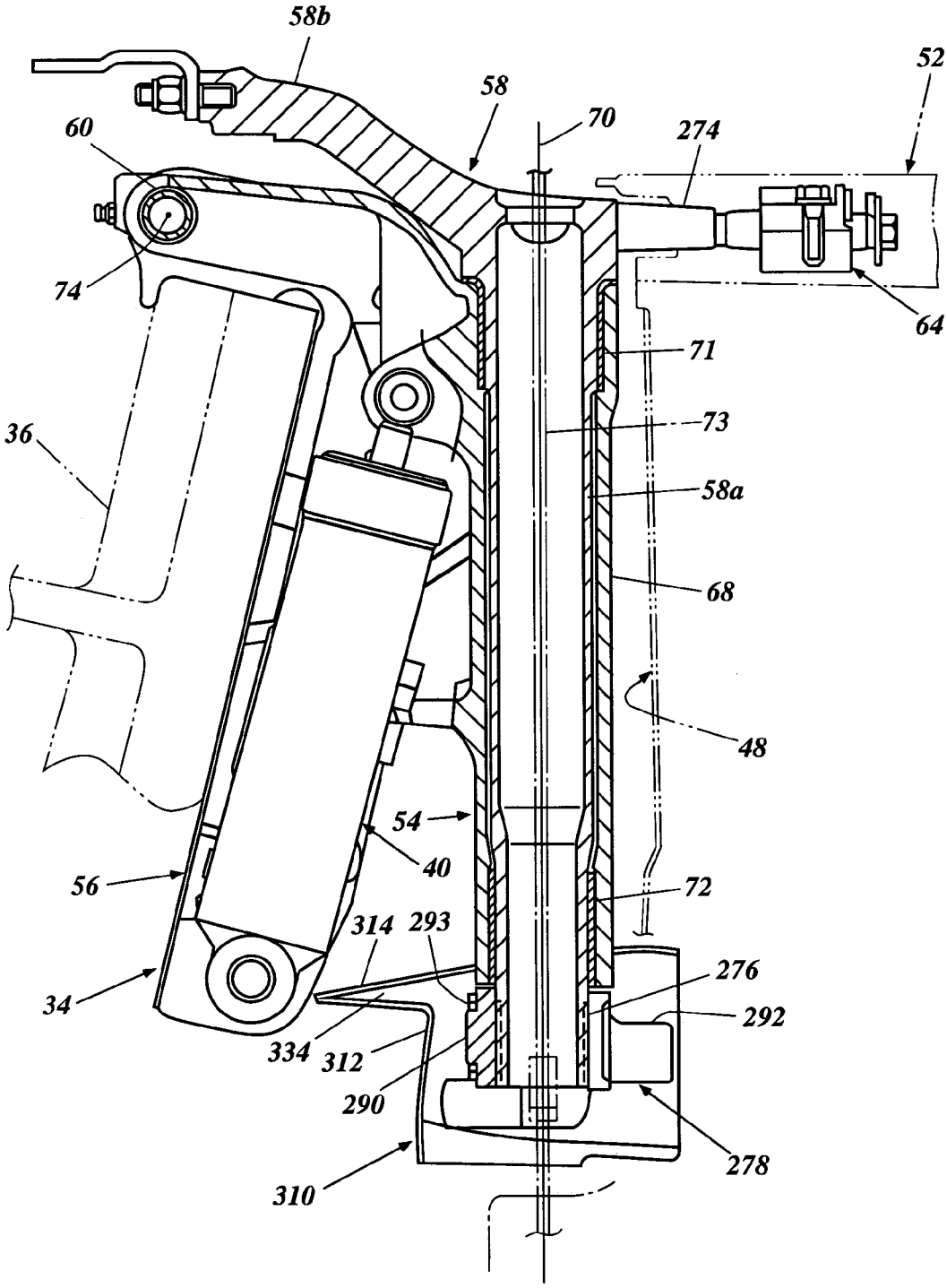
FIG. 20 illustrates a sectional side view showing a tubular section of the swivel bracket.
Figure 21:
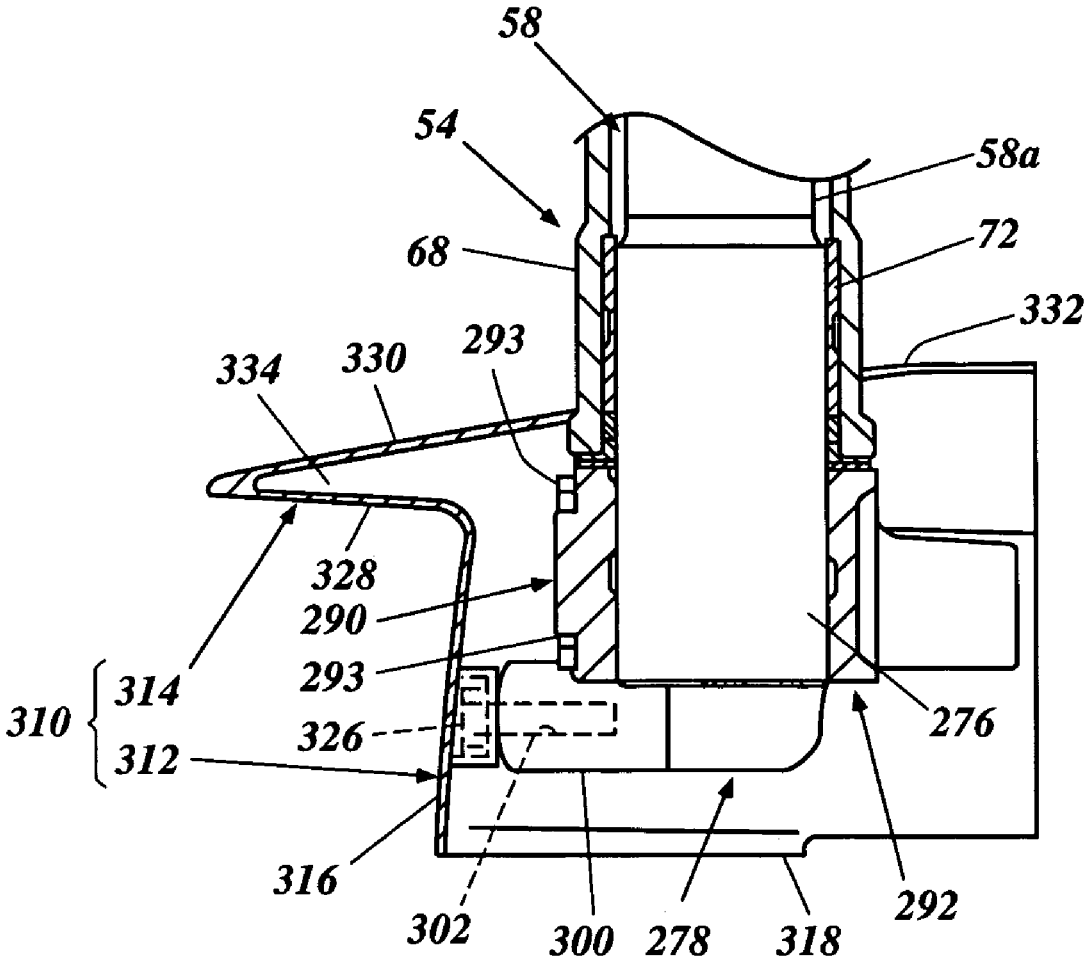
FIG. 21 illustrates a sectional side view showing a lower mount cover attached to a lower mount housing.

The housing unit 46 preferably comprises an upper casing (or driveshaft housing) 48 and a lower casing 50. The upper casing 48 depends from the power head 44 through an exhaust guide 52 (FIG. 20). The upper casing 48 journals a driveshaft that extends generally vertically within the upper casing 48. A top end of the driveshaft is coupled with a bottom end of the crankshaft of the engine. The lower casing 50 depends from the upper casing 48 and is mechanically and electrically coupled with the upper casing 48. The lower casing 50 journals a propulsion shaft that extends generally horizontally within the lower casing 50. The driveshaft and the propulsion shaft are rotatably coupled with each other through a transmission mechanism. The propeller 38 is connected to an end of the propulsion shaft. Thus, the power generated by the engine is transmitted to the propeller 38 through the driveshaft and the propulsion shaft. The propeller 38 rotates to produce the thrust that propels the associated watercraft 36.

The power head 46 has an air inlet through which ambient air is introduced into an inner space of the power head 46. The air is further introduced into the engine for combustion with fuel which is supplied also to the engine through a proper fuel supply system. The upper and lower casings 48, 50 also define an exhaust passage. Exhaust gases discharged from the engine enter the upper casing 48 through the exhaust guide 52 and are discharged to an external location of the casings 48, 50 through the upper and lower casings 48, 50.

With reference to FIGS. 1–27, the bracket assembly 34 and a structure for coupling the upper casing 48 with the bracket assembly 34 are described.

With particular reference to FIGS. 1–3, 20 and 28, the bracket assembly 34 preferably comprises a swivel bracket 54, a clamping bracket 56, a steering member 58 and a tilt pin 60.

Figure 22:
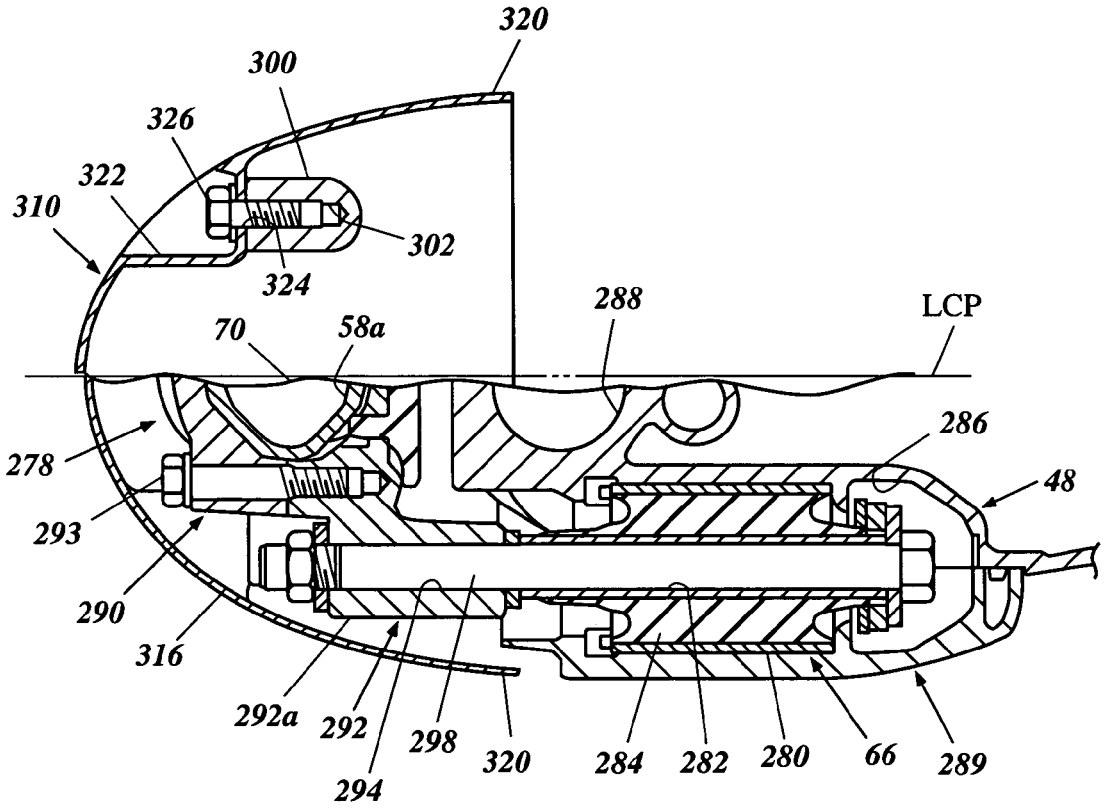
FIG. 22 illustrates a sectional plan view of the lower mount cover of FIG. 21 attached to the lower mount housing.
Figure 23:
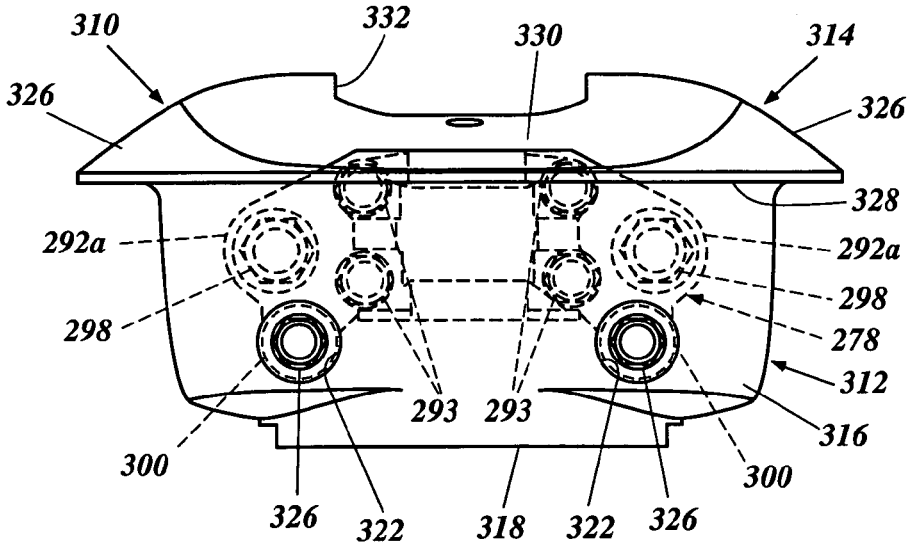
FIG. 23 illustrates a front elevation view of the lower mount cover with an attachment structure thereof.
Figure 24:
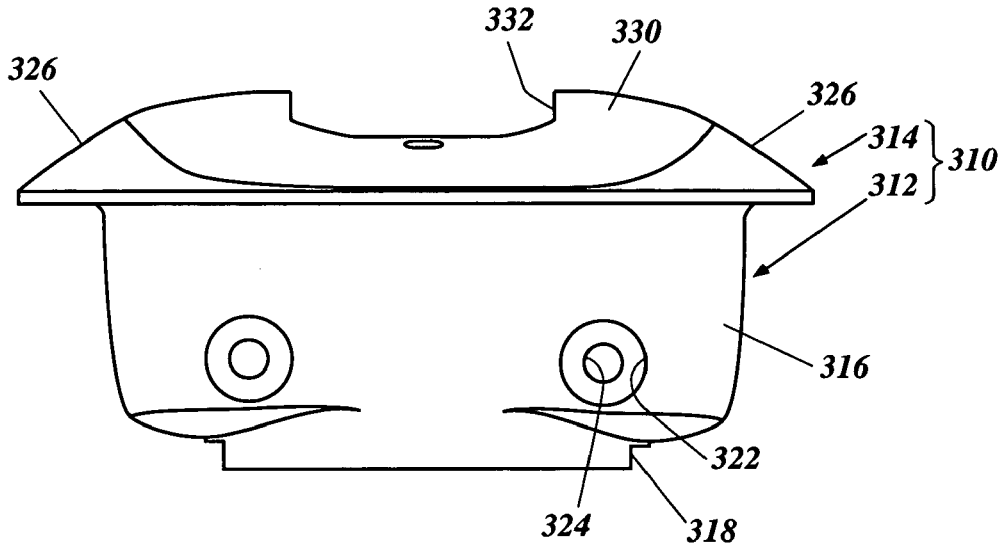
FIG. 24 illustrates another front elevation view of the lower mount cover without the attachment structure thereof.
Figure 25:
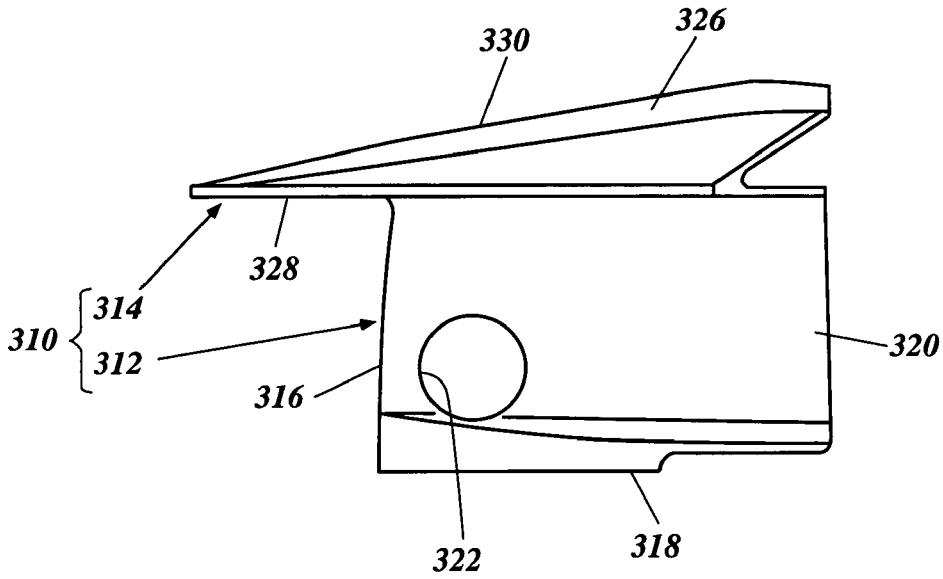
FIG. 25 illustrates a side elevation view of the lower mount cover.
Figure 26:
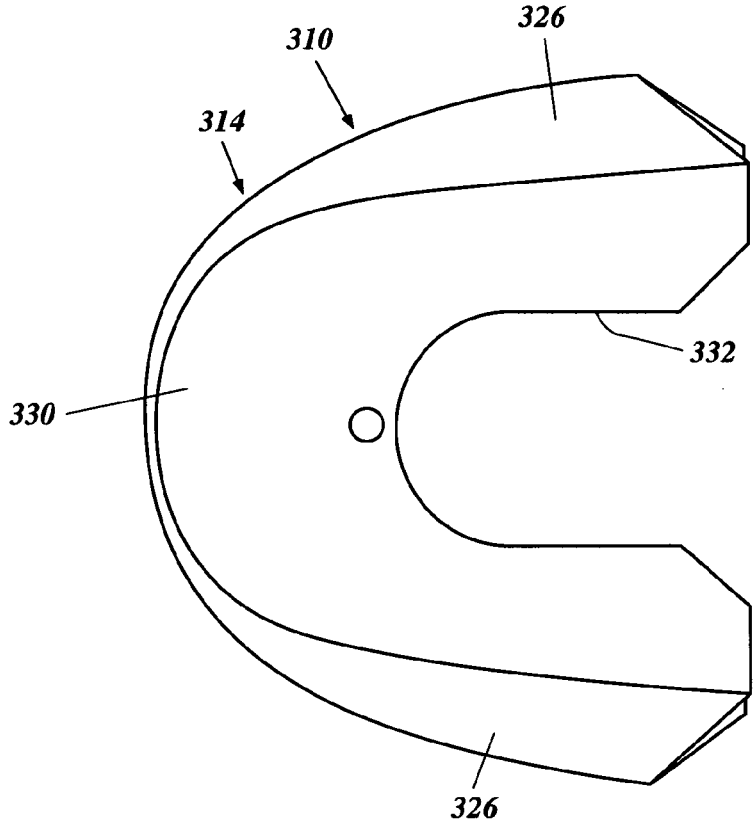
FIG. 26 illustrates a top plan view of the lower mount cover.
Figure 27:
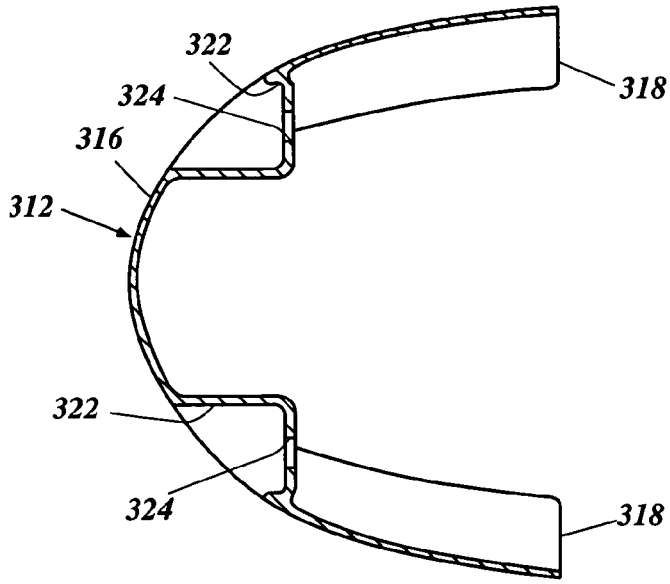
FIG. 27 illustrates another cross-sectional plan view of the lower mount cover without the attachment structure thereof.

As best shown in FIG. 20, the steering member 58 preferably comprises a steering shaft section 58*a* and a steering lever section 58*b* unitarily formed with each other. The illustrated steering shaft section 58*a* is tubular and extends generally vertically. A top end of the steering shaft section 58*a* is affixed to an upper portion of a front surface of the upper casing 48 by an upper mount 64, while a bottom end of the steering shaft section 58*a* is affixed to a lower portion of the front surface of the upper casing 48 by a lower mount 66 (FIG. 22). The steering shaft section 58*a* has a steering axis 70 that extends generally vertically. The upper and lower mounts 64, 66 will be described in greater detail later. The steering lever section 58*b* extends generally forward to be coupled with a proper steering system of the associated watercraft 36.

The swivel bracket 54 preferably has a tubular section 68 that extends generally vertically and that defines an internal space. The steering shaft section 58*a* is fitted into the internal space of the tubular section 68 for pivotal movement about the steering axis 70. As shown in FIG. 20, upper and lower bushings 71, 72 pivotally journal the steering shaft section 58*a* in the tubular section 68. The drive unit 32 thus can be steered with the steering lever section 58*b* operated. In the illustrated embodiment, the steering axis 70 extends along a hypothetical longitudinal center plane LCP (FIG. 2) of the outboard motor 30 that extends vertically and fore to aft. In other words, the longitudinal center plane LCP includes the steering axis 70. Additionally, a shift rod 73 for the transmission mechanism extends vertically through the steering shaft section 58*a*. A preferable structure of the swivel bracket 54 including the tubular section 68 will be described in greater detail below.

The clamping bracket 56 comprises a pair of bracket arms 56*a*, 56*b* that are transversely spaced apart from each other and can be affixed to the watercraft transom 36*a*. The tilt pin 60 extends generally horizontally and completes a hinge coupling between the swivel bracket 54 and the clamping bracket 56, i.e., bracket arms 56*a*, 56*b*. The tilt pin 60 extends through the bracket arms 56*a*, 56*b* such that the clamping bracket 56 supports the swivel bracket 54 for pivotal movement about a tilt axis 74 defined by the tilt pin 60. The tilt axis 74 extends normal to the longitudinal center plane LCP. Because the drive unit 32 is coupled with the swivel bracket 54, both the swivel bracket 54 and the drive unit 32 can be tilted or trimmed together about the tilt axis 74 relative to the clamping bracket 56.

Figure 2:
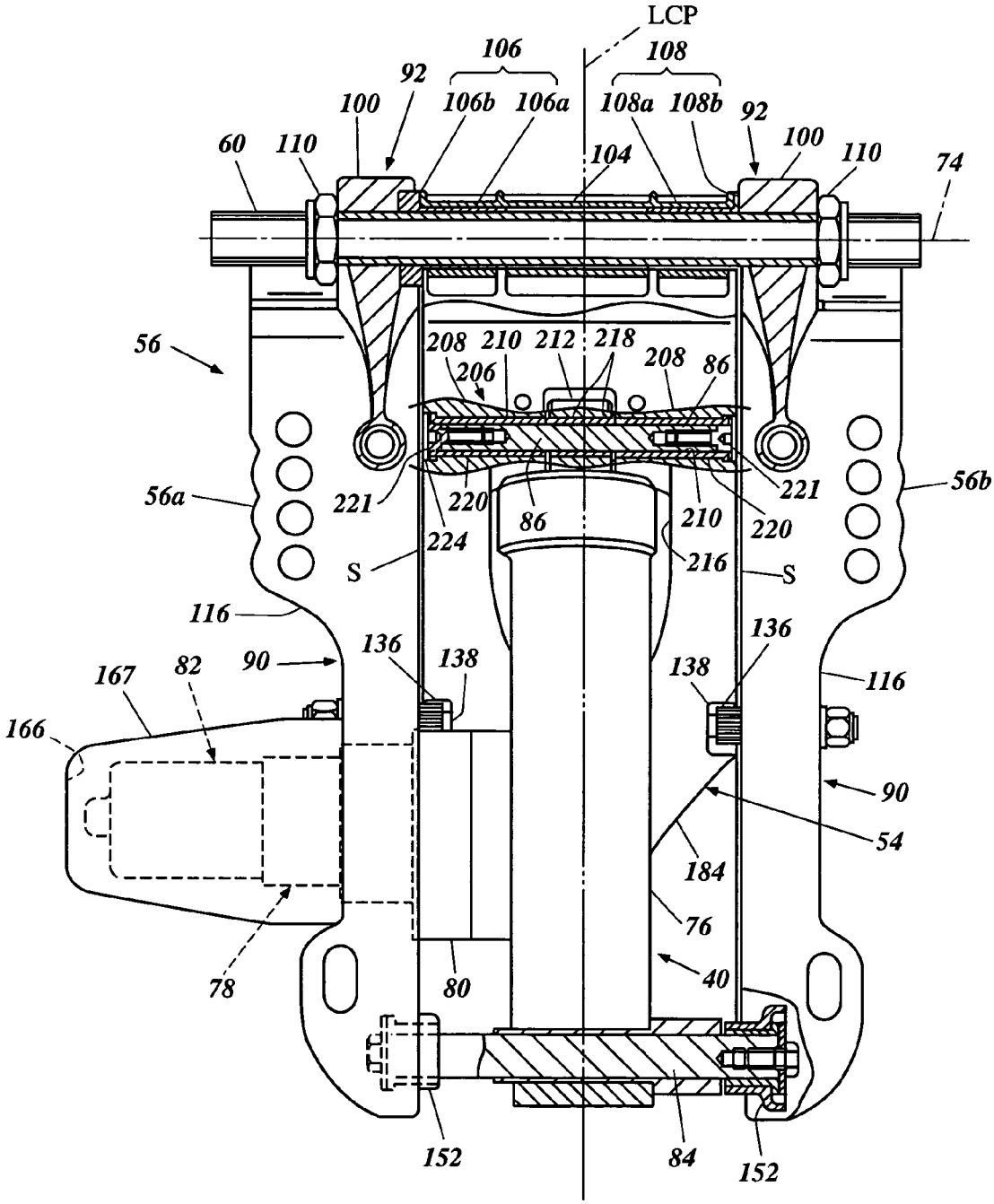
FIG. 2 illustrates a front view of a bracket assembly of the outboard motor of FIG. 1.
Figure 3:
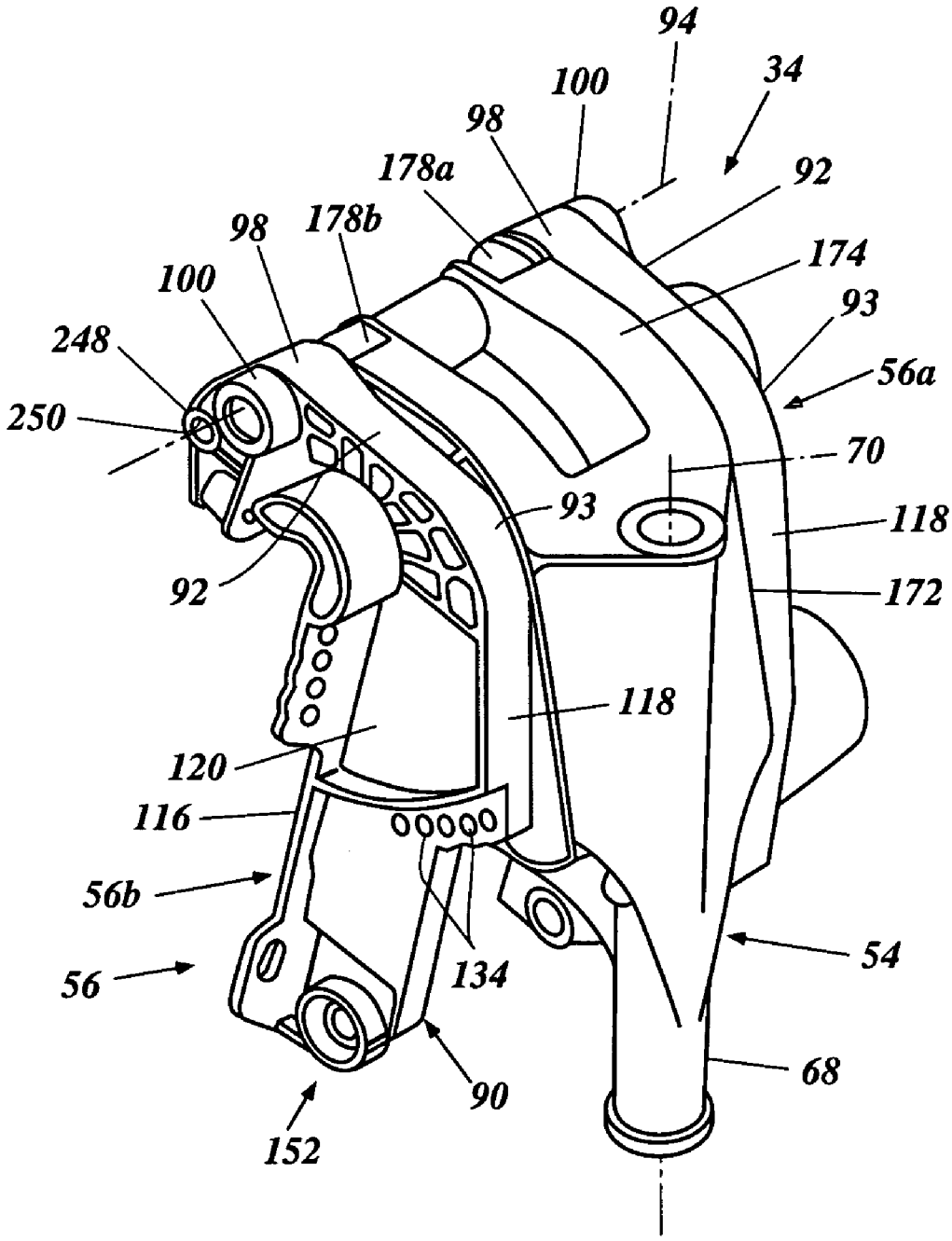
FIG. 3 illustrates a perspective view of the bracket assembly of FIG. 2.

The hydraulic tilt and trim adjustment device 40 is preferably provided between the swivel bracket 54 and the clamping bracket 56 to tilt (raise or lower) the swivel bracket 54 together with the drive unit 32 relative to the clamping bracket 56. As best shown in FIG. 2, the tilt and trim adjustment device 40 preferably comprises a hydraulically operated mechanism that includes a hydraulic cylinder 76, a hydraulic piston reciprocating within the cylinder 76 and a hydraulic unit 78 that powers the piston. The hydraulic unit 78 preferably comprises a hydraulic pump 80 and an electric motor 82 that drives the hydraulic pump 80. The pump 80 and the motor 82 extend generally horizontally and normal to the longitudinal center plane LCP. A piston rod extends outward beyond one end of the cylinder 76. Preferably, a bottom end of the cylinder 76 is pivotally affixed to the clamping bracket 56 by a lower pin 84 while a top end of the piston rod is pivotally affixed to the swivel bracket 54 by an upper pin 86.

The electric motor 82 rotates in a right direction and a reversed direction. When the electric motor 82 is activated, the hydraulic pump 80 operates and the piston rod extends from the cylinder 76 or retracts into the cylinder 76. With the extending movement of the piston rod, the swivel bracket 54 with the drive unit 32 is tilted up. With the retracting movement of the piston rod, the swivel bracket 54 with the drive unit 32 is tilted down.

Although not shown, the tilt and trim adjustment device 40 can have a conventional shock absorbing mechanism to absorb the shock generated when a floating object strikes the drive unit 32 or the drive unit 32 runs into a rock or the like.

Figure 28:
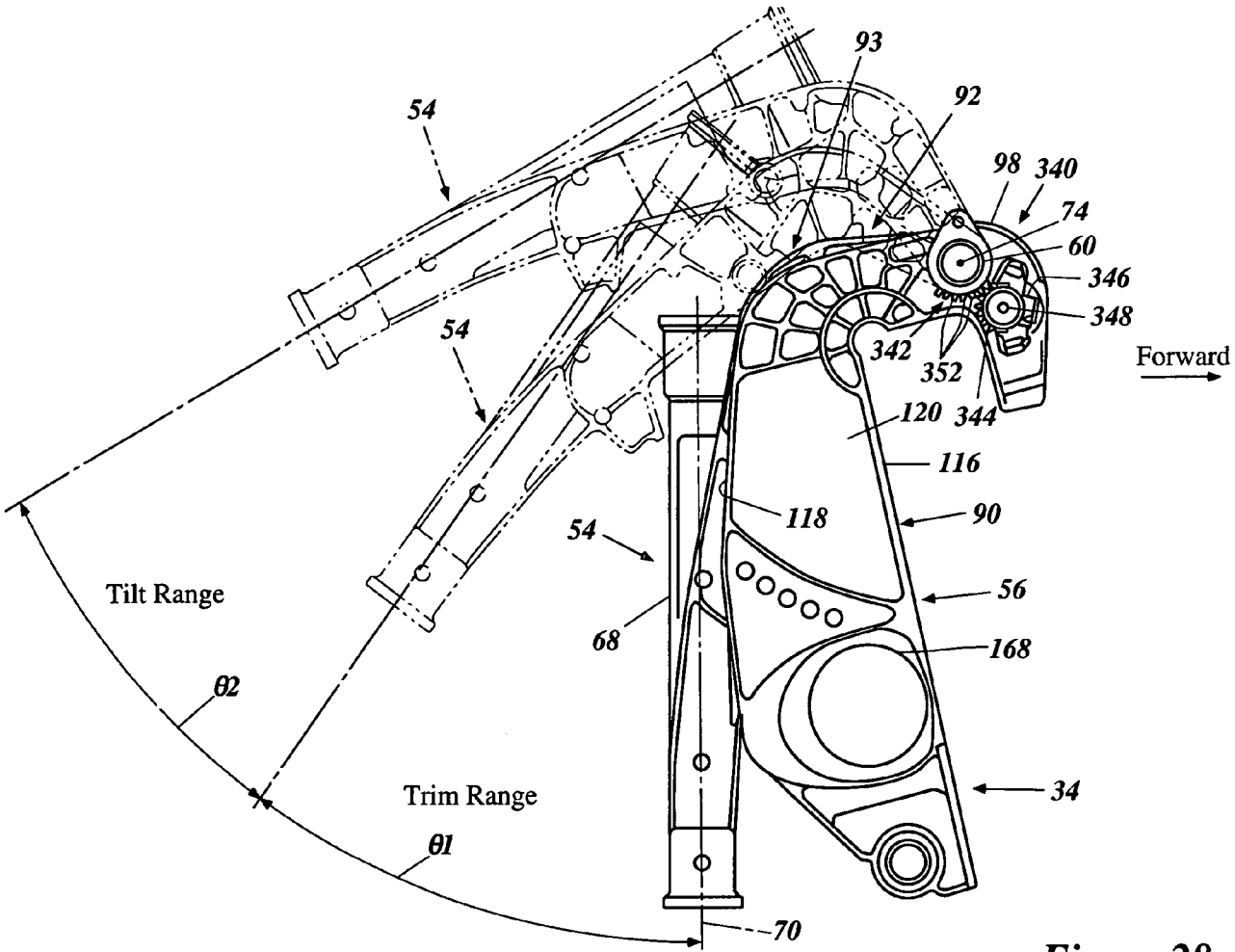
FIG. 28 illustrates a schematic side elevation view of the bracket assembly showing a movable range of the swivel bracket, the solid line showing a fully trimmed-down position thereof and the phantom lines showing a fully trimmed-up position and a fully tilted-up position.
Figure 29:
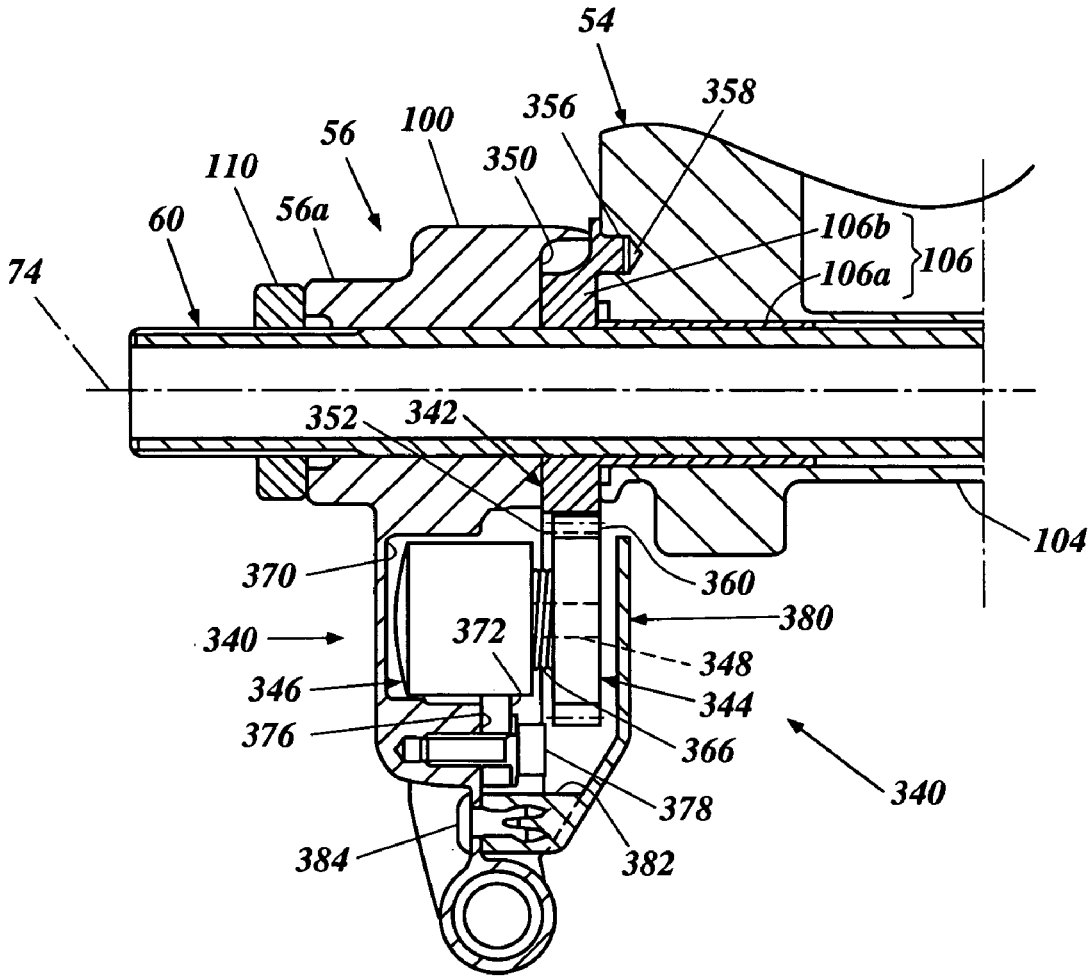
FIG. 29 illustrates a front sectional view of a trim and tilt position sender mechanism attached to the swivel and clamping brackets.
Figure 30:
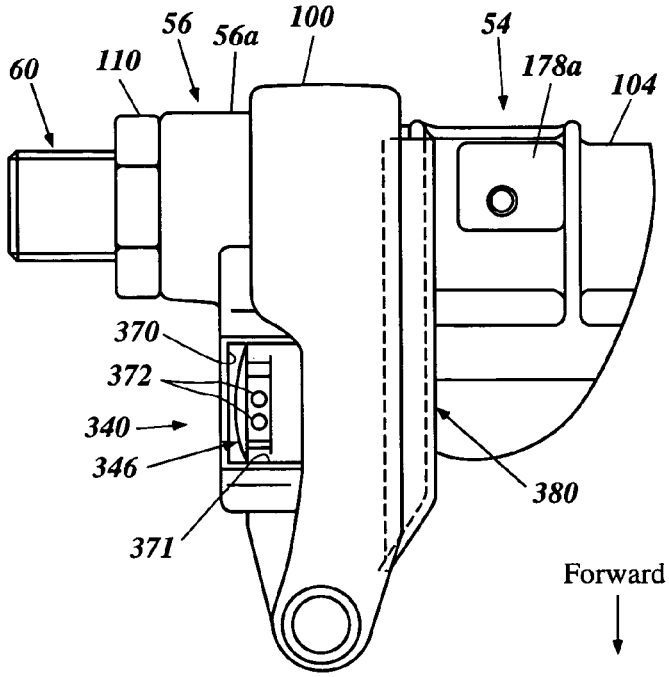
FIG. 30 illustrates a front elevation view of the trim and tilt position sender mechanism of FIG. 29.
Figure 31:
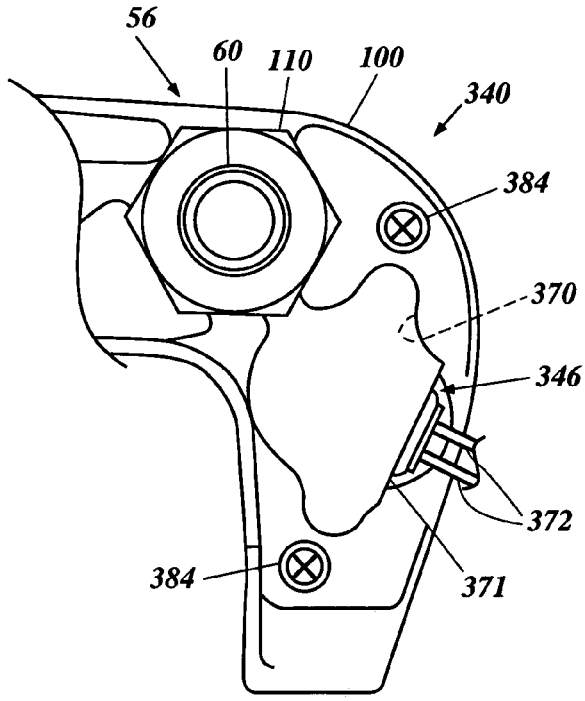
FIG. 31 illustrates a side elevation view (starboard side view) of the trim and tilt position sender mechanism.
Figure 32:
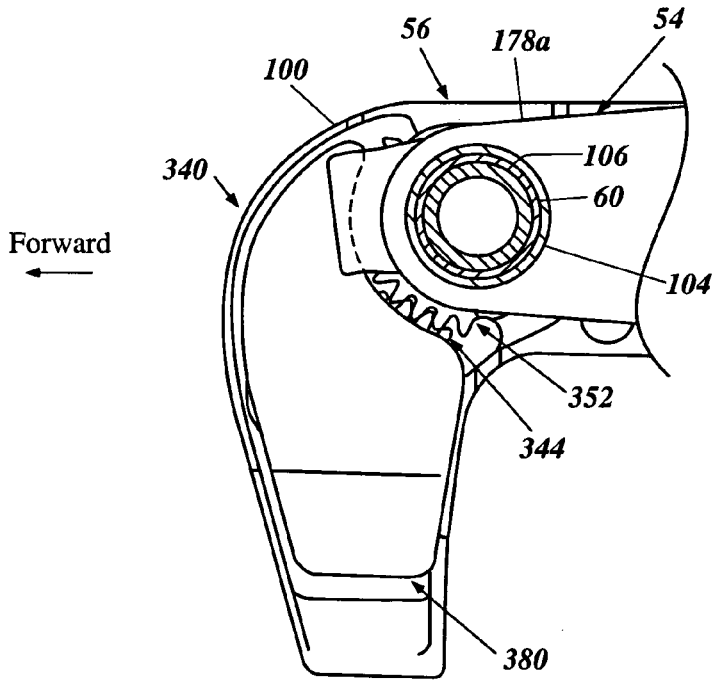
FIG. 32 illustrates a side elevation view (port side view) of the trim and tilt position sender mechanism covered by a cover.

With reference to FIG. 28, the swivel bracket 54 moves between a fully tilted down position that is the most lowered position of the swivel bracket 54 and a fully tilted up position that is the most raised position of the drive unit 32 when the tilt and trim adjustment device 40 is activated. Preferably, a lower tilt range θ1 is a trim adjustment range. The rest of the tilt range θ2 is a tilt range in the narrow sense of the word.

Normally, the propeller 38 is submerged while the drive unit 32 moves during the trim adjustment range θ1. A position of the watercraft 36 varies in accordance with a trim adjustment position when the propeller 38 is powered. A higher trim adjustment position is suitable for a high speed running of the watercraft 36 because a bow portion of the watercraft 36 can be slightly lifted up by the thrust of the propeller 38 and the watercraft 36 can easily transfer to a planing state. On the other hand, a lower trim adjustment position is suitable for a low speed running that includes a troll running and also for accelerating the running speed. In general, the propeller 38 can be out of the water while the drive unit 32 moves in the tilt range θ2. The drive unit 32 is placed at a position in the tilt range if the, operator or user wants to keep the drive unit 32 out of the water.

With particular reference to FIGS. 1–7 and 14, the clamping bracket 56 is described in greater detail below.

As described above, the bracket arms 56*a*, 56*b* form the clamping bracket 56. In the illustrated embodiment, each bracket arm 56*a*, 56*b* is made of aluminum alloy, and is produced in a vacuum die casting process. Generally, first and second dies are placed to define a cavity therebetween. Preferably, one of the first and second dies is a fixed die, while the remainder one is a movable die so that the cavity is adjustably created. Molten aluminum alloy is introduced into the cavity under a negative pressure. The dies are removed after the aluminum alloy has become hard. The aluminum alloy in the cavity forms the bracket arm 56*a*, 56*b*. Because both the bracket arms 56*a*, 56*b* preferably have almost the same configuration as each other, the bracket arm 56*b* placed on the port side is primarily described below to represent both of them.

Figure 5:
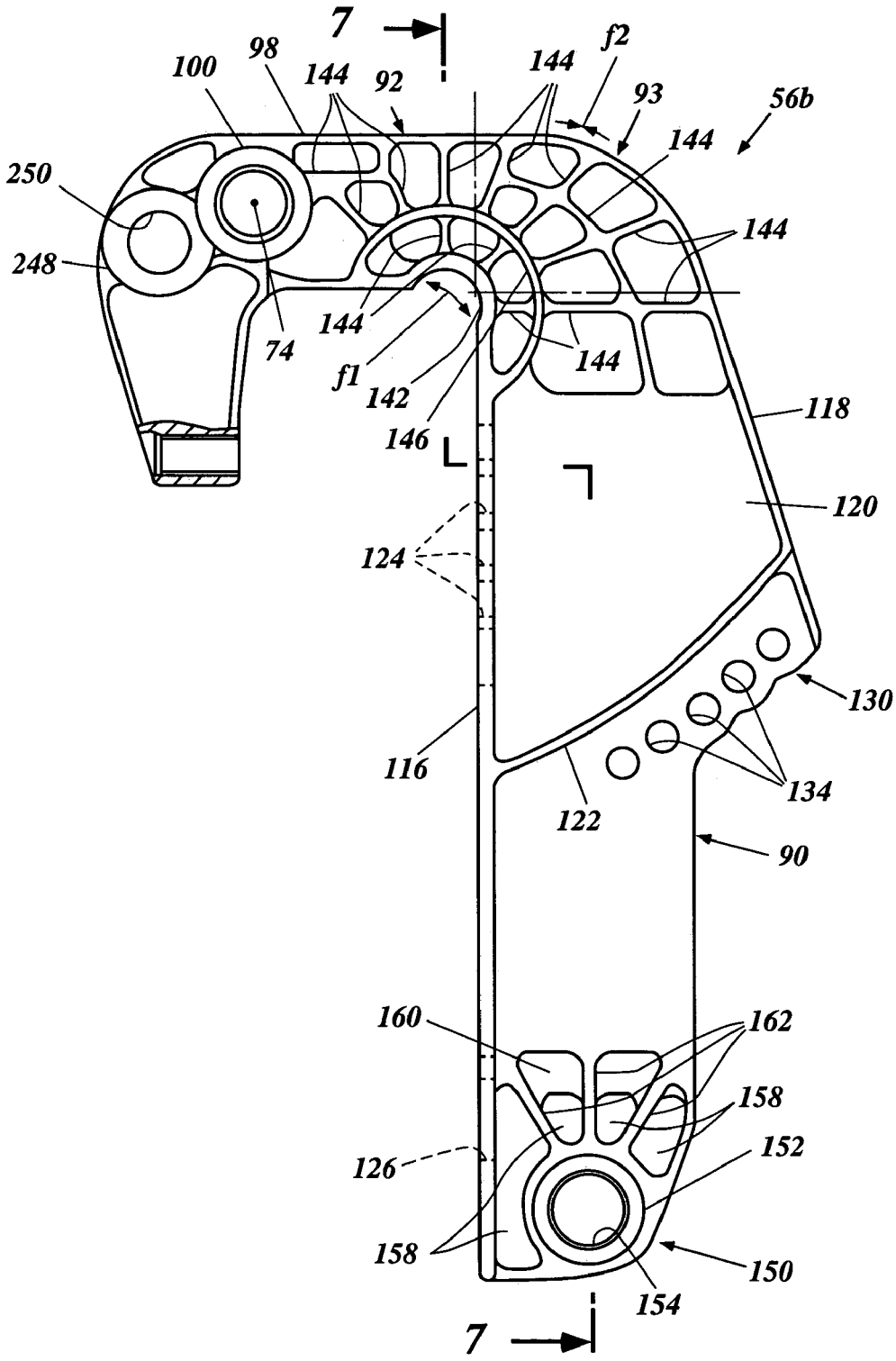
FIG. 5 illustrates a side elevation view (outside view) of the bracket arm disposed on the port side.

As best shown in FIG. 5, the bracket arm 56*b* preferably comprises a vertical section 90, a horizontal section 92 and a merging section (or bending section) 93. The vertical section 90 extends generally vertically and has a front surface that can abut on a rear surface of the watercraft transom 36*a*. The horizontal section 92 extends generally horizontally and has a bottom surface that abuts on a top surface of the watercraft transom 36*a*. A forward portion 98 of the horizontal section 92 preferably includes an end that extends downward and can abut on a front surface of the transom 36*a* to provide the secure fixation of the bracket arm 56*b* on the transom 36*a*. The vertical section 90 and the horizontal section 92 merge together in the merging section 93. FIG. 5 schematically shows respective areas of the vertical, horizontal and merging sections 90, 92, 93.

The forward portion 98 of the horizontal section 92 preferably has a tilt pin boss 100 through which an aperture is defined. The aperture transversely extends and journals the tilt pin 60. The respective bracket arms 56*a*, 56*b* are spaced apart from each other to interpose a tubular tilt pin boss 104 of the swivel bracket 54. As best shown in FIG. 2 and also shown in FIG. 37, the tilt pin 60 extends through both the tilt pin bosses 100 of the bracket arms 56*a*, 56*b* and the tilt pin boss 104 of the swivel bracket 54.

In the illustrated embodiment, a pair of bushings 106, 108 journal the tilt pin 60 within the tilt pin boss 104 of the swivel bracket 54. The bushing 106 preferably has a tubular portion 106*a* and a flange portion 106*b*. The tubular portion 106*a* supports the tilt pin boss 104 of the swivel bracket 54 around the tilt pin 60. The flange portion 106*b* abuts on a flange of the tilt pin boss 104 of the swivel bracket 54 and also abuts on an inner surface of the tilt pin boss 100 of the bracket arm 56*b*.

The bushing 108 preferably has a tubular portion 108*a* and a flange portion 108*b*. The tubular portion 108*a* supports the tilt pin boss 104 of the swivel bracket 54 around the tilt pin 60. The flange portion 108*b* abuts on a flange of the tilt pin boss 104 of the swivel bracket 54 and also abuts on an inner surface of the tilt pin boss 100 of the bracket arm 56*b*. Preferably, a width of the flange portion 106*b* is larger than a width of the flange portion 108*b*. Also, the tilt pin boss 100 of the bracket arm 56*b* has a recess which can embrace the flange portion 106*b* of the bushing 106. A pair of nuts 110 are screwed up on both outer surfaces of the respective tilt pin bosses 100 to securely couple the tilt pin 60 with the bracket arms 56*a*, 56*b*. Thus, the tilt pin boss 104 of the swivel bracket 54 can pivot about the tilt axis 74 of the tilt pin 60. The bushing 106 will be described in greater detail later.

The bracket arm 56*b* preferably comprises an inner flange (or first flange) 116, an outer flange (or second flange) 118 and a web 120. The inner flange 116 forms an inner verge of the bracket arm 56*b* and the outer flange 118 forms an outer verge of the bracket arm 56*b*. The web 120 extends between the inner and outer flanges 116, 118 to connect those flanges 116, 118. That is, the inner flange 116 generally extends next to and along the watercraft transom 36*a*, while the outer flange 118 is spaced a part from the transom 36*a* by the web 120. Although the entire bracket arm 56*b* does not necessarily have this flange-web-flange structure, the merging section 93 preferably has the structure. A thickness of the respective flanges 116, 118 and the web 120 is preferably in a range between 1.5 mm and 5.0 mm. This range of thickness, however, is merely exemplary and the flanges can have other thicknesses as well. Preferably, the thickness of the inner flange 116 is equal to or larger than the thickness of the outer flange 118. Additionally, the respective flanges 116, 118 and the web 120 can have the same thickness or can take a different thickness from each other.

Figure 7:
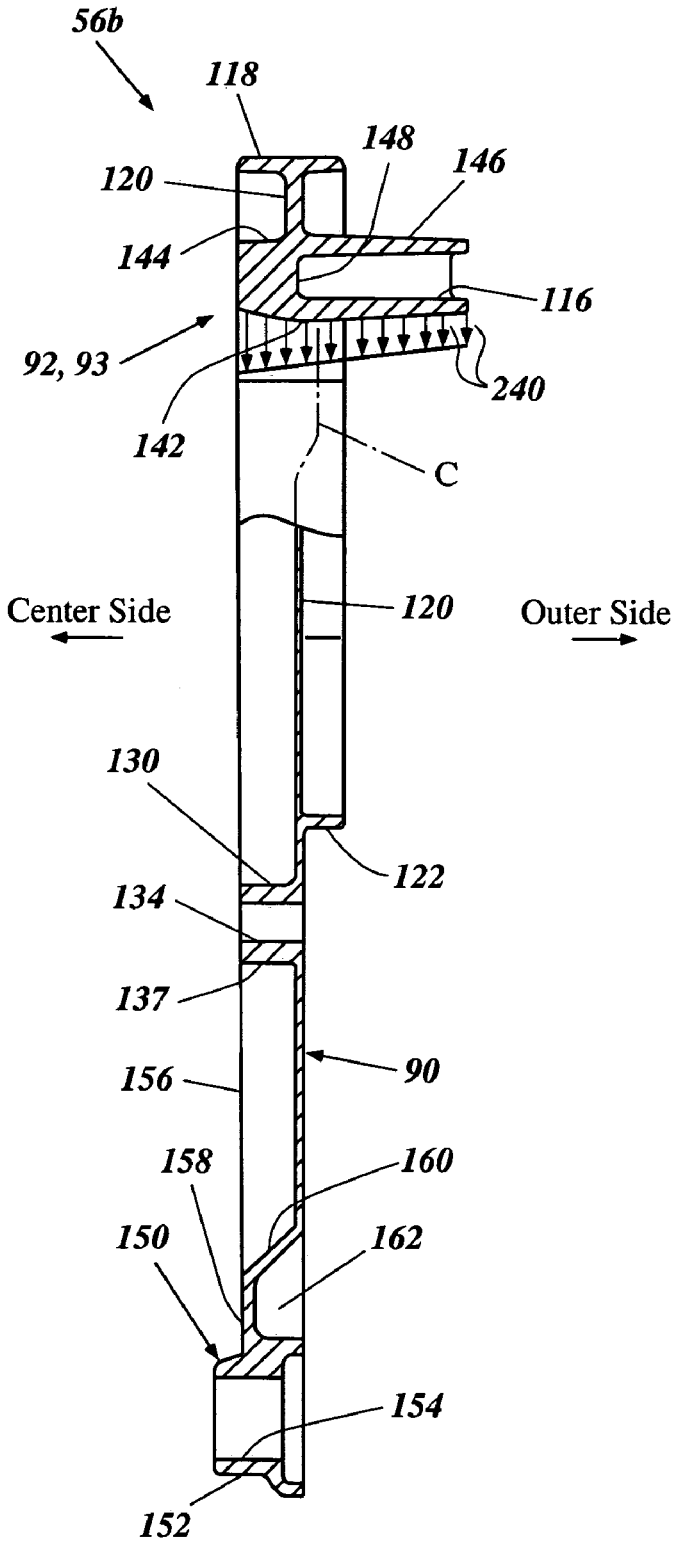
FIG. 7 illustrates a cross-sectional view of the bracket arm taken along line 7—7 of FIG. 5.

Preferably, the inner and outer flanges 116, 118 extend parallel to the tilt axis 74, while the web 120 extends normal to the tilt axis 74. As best shown in FIG. 7, the bracket arm 56*b* basically has an I-shape in a transverse cross-section. That is, the bracket arm 56*b* generally forms an I-beam. Both center side surface (a side facing to the longitudinal center plane LCP) and outer side surface (the other side) of the web 120 are generally flat.

The inner flange 116 abuts on the rear surface of the watercraft transom 36*a*. An upper portion of the inner flange 116 is preferably wider than the remainder portion (i.e., lower portion) so that the clamping bracket 56 can surely grasp the transom 36*a*. In the illustrated embodiment, an area of the web 120 gradually expands toward a center of the bracket arm 56*b* from the horizontal section 92 in the vertical direction, because the vertical section 90 extends obliquely rearward downward. An intermediate flange or reinforcing flange-like portion 122 extends between the inner and outer flanges 116, 118 generally in the center of the bracket arm 56*b*. The illustrated intermediate flange 122 extends obliquely so that an end portion thereof on the outer flange side is positioned higher than another end portion on the inner flange side. The vertical section 90 is narrowed in its lower portion and extends downward generally straightly. A lower area of the web 120 thus is narrowed also. The vertical section 90 of the bracket arm 56*a* has a slightly different configuration below the intermediate flange 122. That is, the vertical section 90 of the bracket arm 56*a* extends downward generally straightly from a portion where the end portion of the intermediate flange 122 is positioned and then relatively steeply extends forward.

The inner flange 116 preferably has a plurality of apertures 124 in the upper portion and a slot 126 in the lower area. The bracket arm 56*b* is affixed to the watercraft transom 36*a* by bolts, one inserted into one of the apertures 124 and another inserted into the slot 126. The user can select one of the apertures 124 in accordance with the height of the transom 36*a*.

The web 120 preferably has a trim position regulating section 130 just below the intermediate flange 122 to selectively determine the lowest position of the trim adjustment range θ1. The trim position regulating section 130 preferably comprises a plurality of apertures 134 that line up along the intermediate flange 122 and a pair of trim position regulating pins 136 that can be selectively inserted into one of the apertures 134 on each bracket arm 56*a*, 56*b*. Respective axes of the apertures 134 extend parallel to the tilt axis 74. As best shown in FIG. 7, the intermediate flange 122 preferably has a boss 137 which defines the apertures 134.

Figure 9:
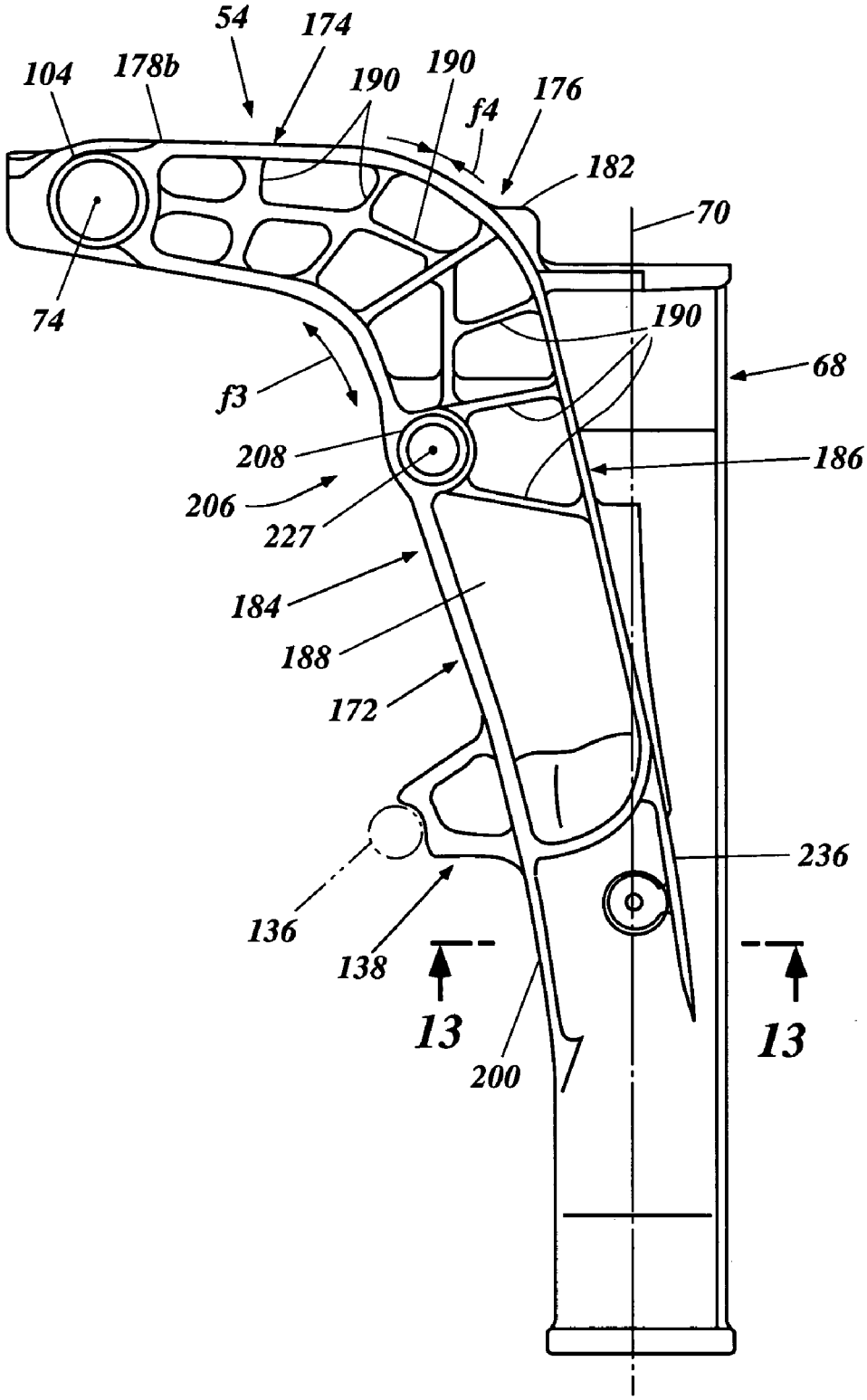
FIG. 9 illustrates a side elevation view (port side view) of the swivel bracket of FIG. 8.
Figure 10:
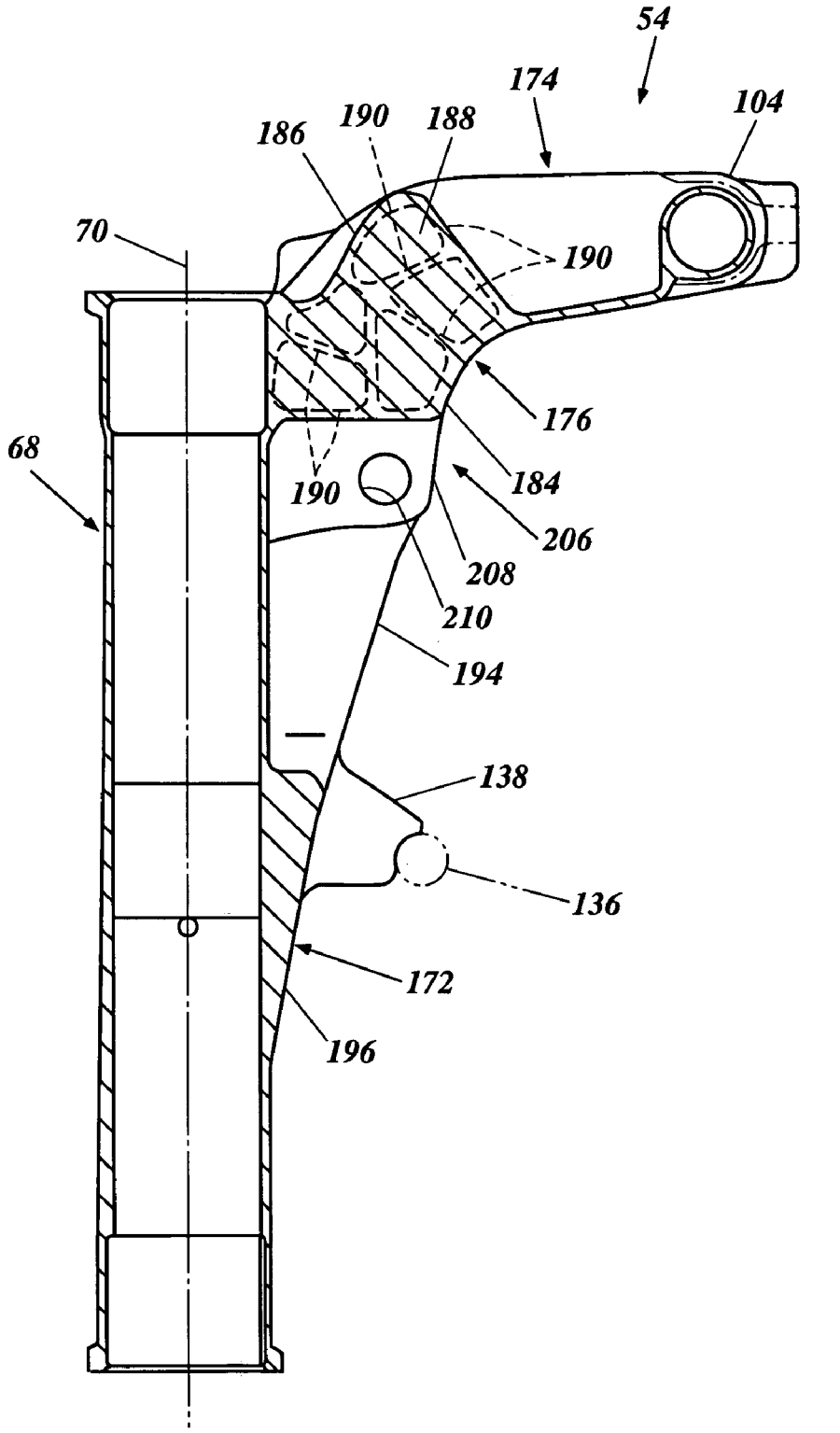
FIG. 10 illustrates a cross-sectional view of the swivel bracket taken along line 10—10 of FIG. 11.
Figure 11:
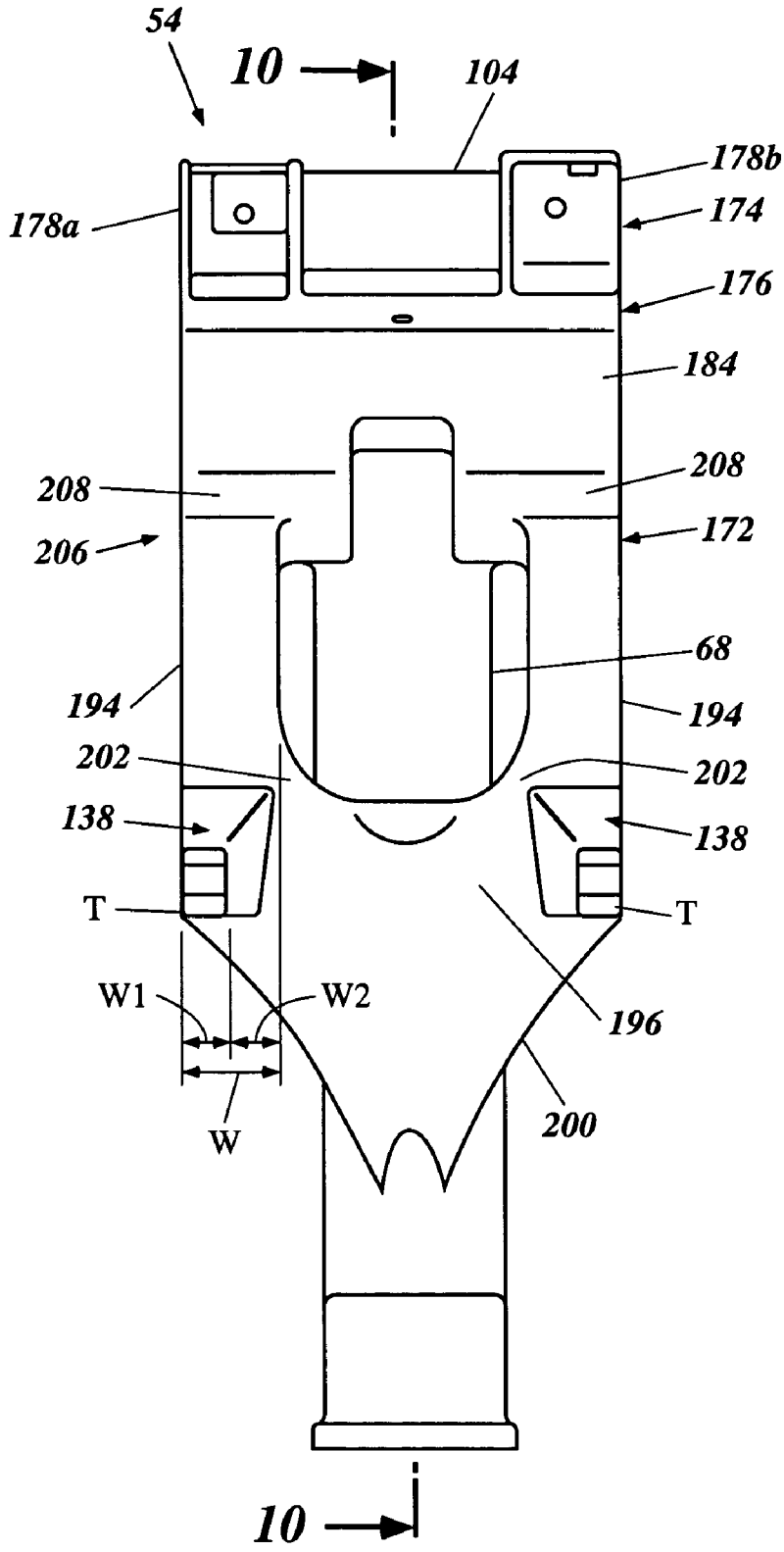
FIG. 11 illustrates a front view of the swivel bracket.
Figure 12:
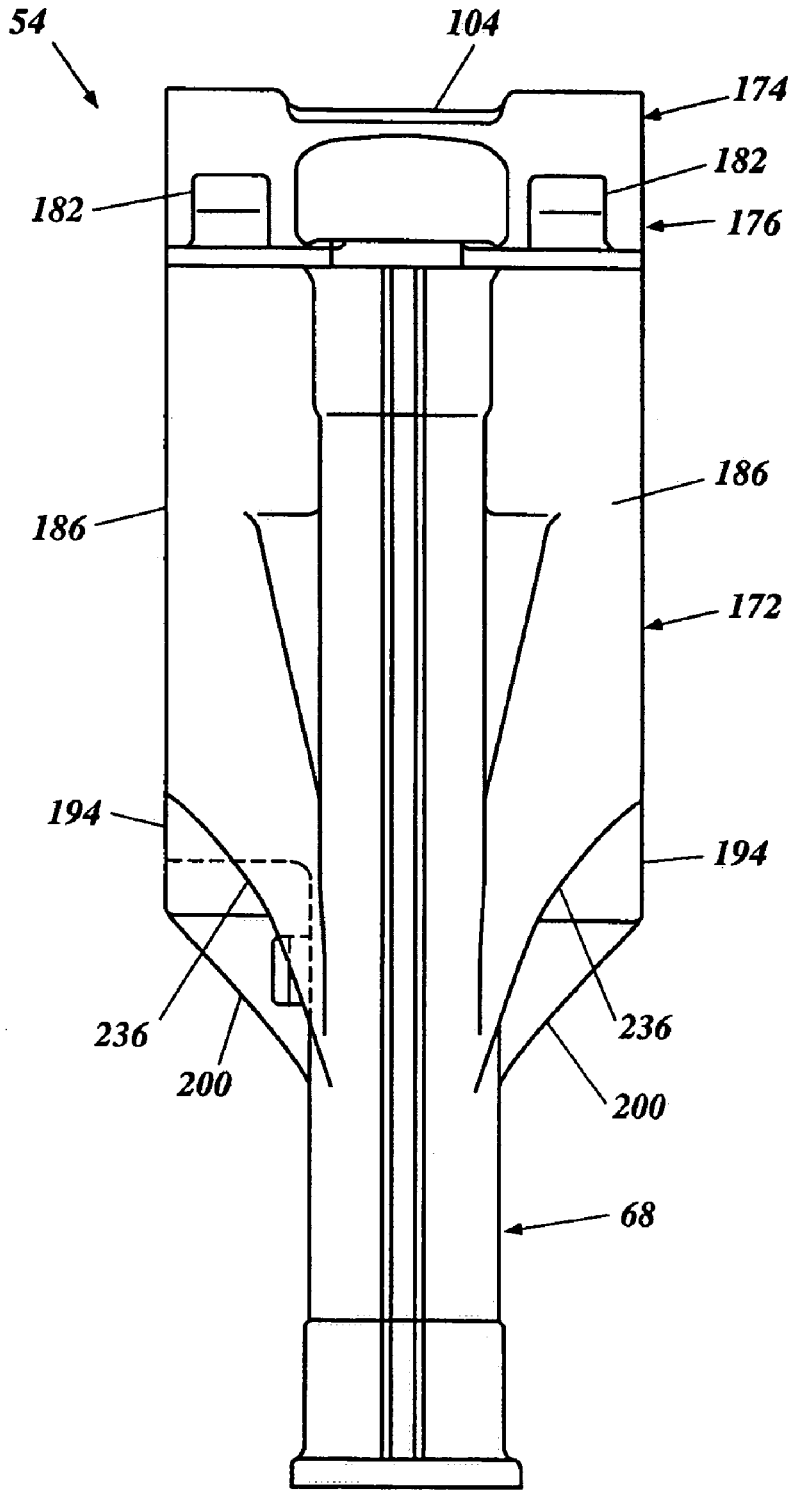
FIG. 12 illustrates a rear view of the swivel bracket.
Figure 13:
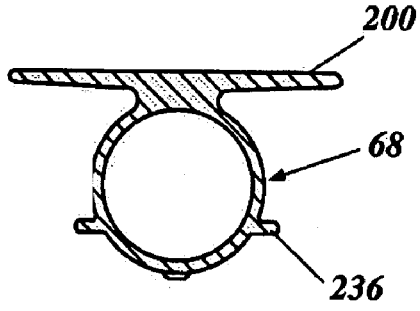
FIG. 13 illustrates a cross-sectional view of the swivel bracket taken along line 13—13 of FIG. 9.

As shown in FIGS. 9–11, the illustrated swivel bracket 54 has stopper sections 138. The stopper sections 138 extend generally forward to correspond to the respective trim position regulating pins 136. Thus, the stopper sections 138 abut on the associated trim position regulating pins 136 when the swivel bracket 54 is most lowered and limit the position of the swivel bracket 54. Also, the stopper sections 138 can prevent the swivel bracket 54 from moving rightward or leftward by a side thrust that is generated while the associated watercraft 36 turns.

Figure 6:
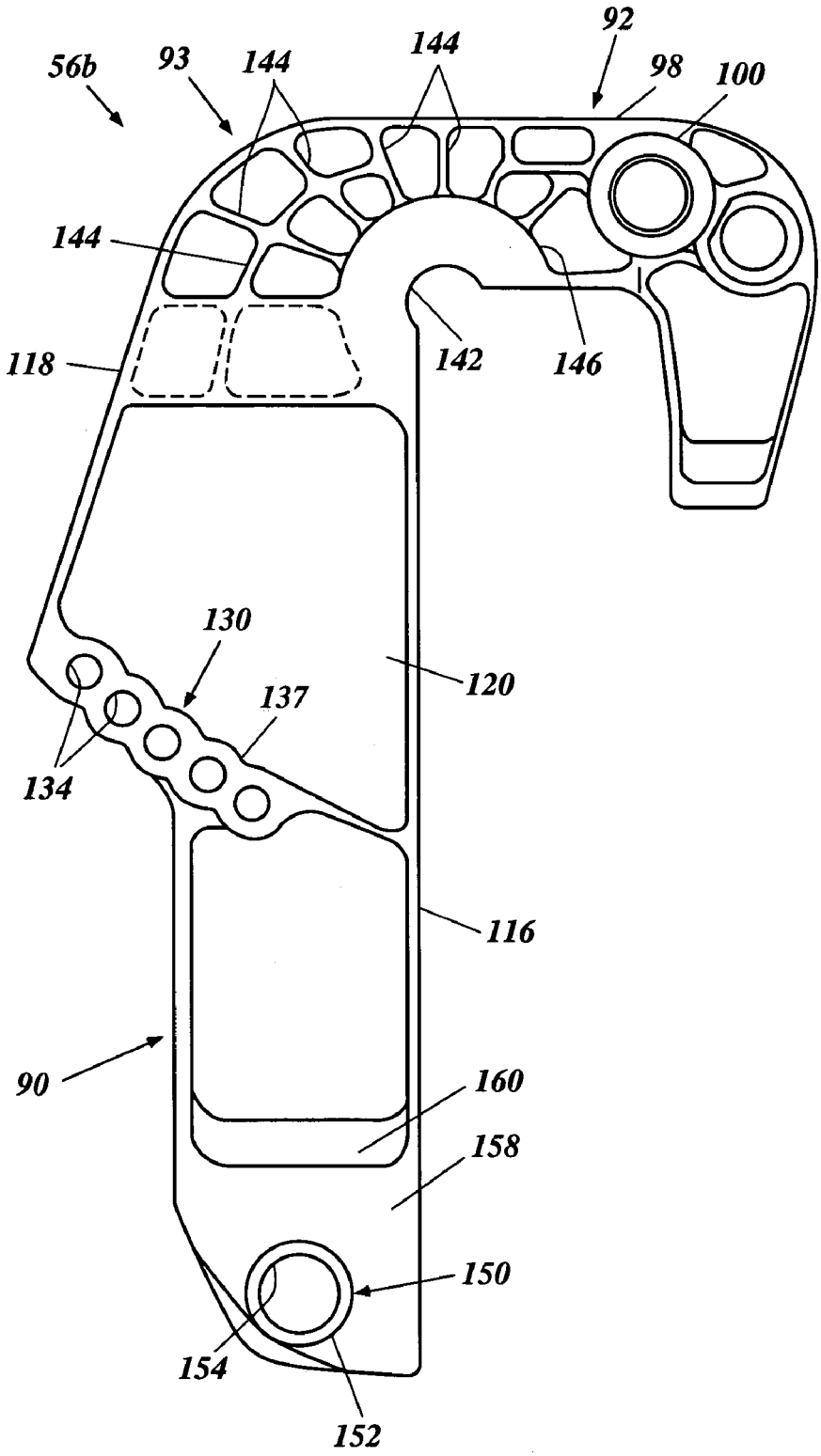
FIG. 6 illustrates another side elevation view (inner side view) of the bracket arm of FIG. 5.

As best shown in FIGS. 5 and 6, the inner flange 116 preferably has an arcuate recess 142 at a corner where a top end line of the vertical section 90 intersects a rear end line of the horizontal section 92. The arcuate recess 142 is provided for the inner flange 116 to avoid the interference with a top edge of the watercraft transom 36*a*. More specifically, in the illustrated embodiment, a hypothetical center of the recess 142 is positioned slightly more forward than a point where a hypothetical horizontal line including the top end of the vertical section 90 intersects a hypothetical vertical line that includes the rear end of the horizontal section 92.

As best shown in FIG. 5, a portion of the web 120 preferably has a plurality of ribs 144. The illustrated ribs 144 extend in the merging section 93, a major part of the horizontal section 92 and a top part of the vertical section 90. Preferably, some of the ribs 144 extend between the inner and outer flanges 116, 118 and radiate from the center of the arcuate recess 142, while other ribs 144 extend generally normal to the radially disposed ribs 144 to form an arc or arcs. That is, the ribs 144 preferably extend in the area of the web 120 to form a net-like structure. In the illustrated embodiment, the ribs 144 generally extend parallel to the tilt axis 74.

The ribs 144 advantageously reinforce the flange-web-flange structure of the clamping bracket 56. The rigidity or strength of the clamping bracket 56 thus is improved.

Preferably, another intermediate flange or reinforcing flange-like portion 146 extends generally coaxially with the arcuate recess 142 between two portions of the inner flange 116 that interpose the arcuate recess 142. That is, the intermediate flange 146 generally has an arcuate shape to extend along the arcuate recess 142. The intermediate flange 146 is preferably positioned closer to the inner flange 116 than the outer flange 118. The intermediate flange 146 preferably extends parallel to the tilt axis 74.

The intermediate flange 146 can primarily bear at least part of a stress that is given to the inner flange 116 and also can reinforce the inner flange 116. Particularly, the intermediate flange 146 can inhibit the inner flange 116 from being weakened by the arcuate recess 142. This is because the arcuate recess 142 can weaken the inner flange 116 against tensile stress. The intermediate flange 146 can reinforce the inner flange 116 against the tensile stress. Thus, the inner flange 116 does not need to be thickened, which consequently increases the weight of the clamping bracket 56.

Figure 4:
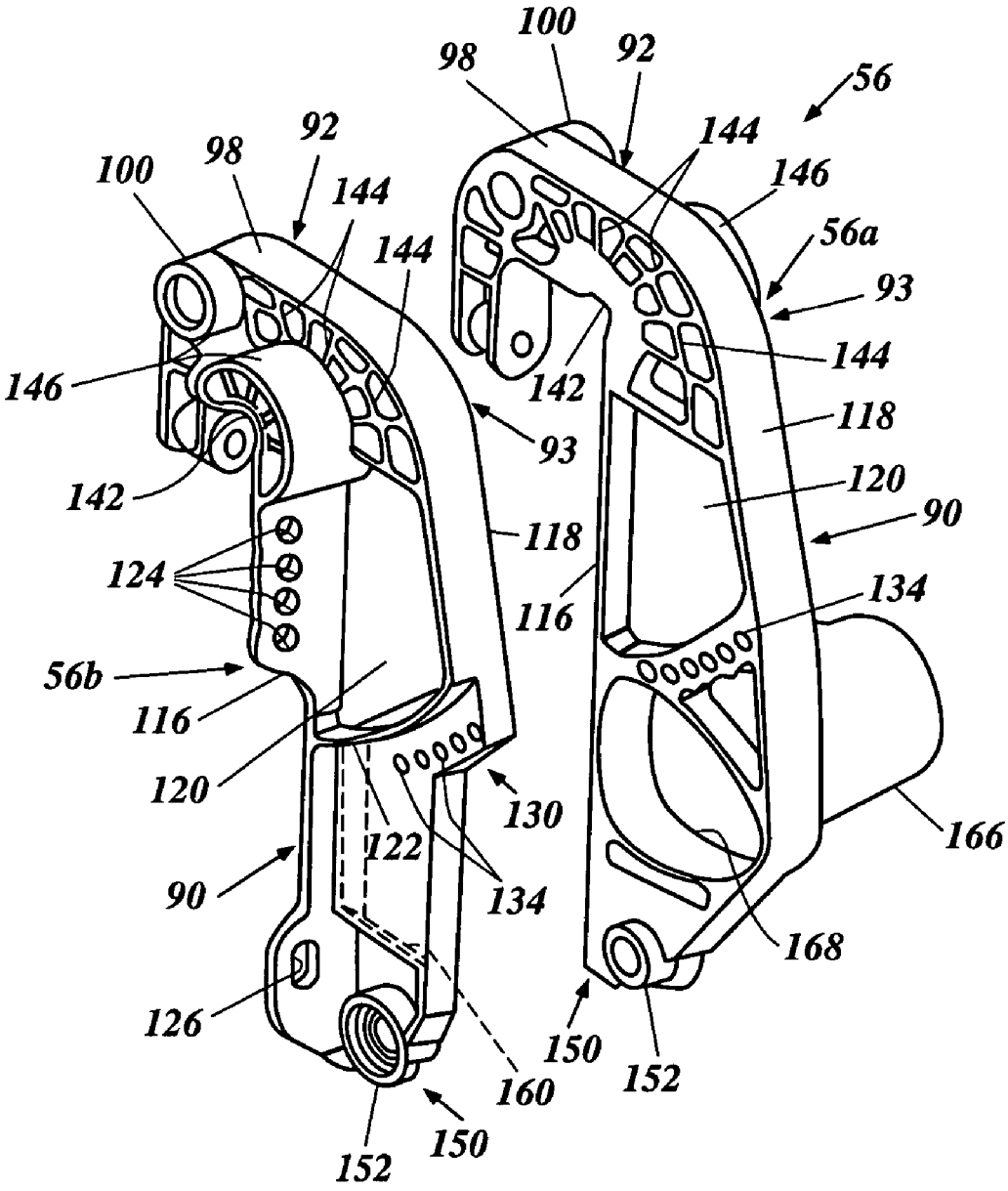
FIG. 4 illustrates a perspective view showing a pair of bracket arms which form a clamping bracket of the bracket assembly of FIG. 2.

As best shown in FIGS. 4 and 7, in general, a portion of the inner flange 116 in a range from its forward end of the horizontal section 92 to a mid part of the vertical section 90 is preferably wider than the remainder portion of the inner flange 116. Also, the intermediate flange 146 preferably has a broad area that is generally equal to the portion of the inner flange 116 discussed above. A portion of the bracket arm 56*b* between the inner flange 116 and the intermediate flange 146 on its outer side defines a cast hole 148 that has a depth that reaches the position of the web 120. Another portion corresponding to the portion between the inner flange 116 and the intermediate flange 146 on its center side defines no cast hole. In this description, the term "center side" means the side that faces the longitudinal center plane LCP, and the term "outer side" means the opposite side of the center side.

Preferably, the foregoing dies used in the vacuum die casting process are movable relative to each other along the tilt axis 74. The first and second dies are preferably set such that a part of a parting line C of the first and second dies corresponding to the merging section 93 is positioned farther from the longitudinal center plane LCP than another part of the parting line C corresponding to the vertical section 90. In other words, the first and second dies are set to place the part of the parting line C corresponding to the vertical section 90 closer to the longitudinal center plane LCP than the other part of the parting line C corresponding to the merging section 93.

The positioning of the parting line C is advantageous to relieve a stress concentration in the area of the merging section 93. That is, in general, burrs are inevitably made at a parting line. Although such burrs are removed as much as possible, remaining burrs, if any, can cause stress concentration. As schematically indicated by the multiple arrows 240 of FIG. 7, generally, the stress concentration at the side closer to the longitudinal center plane LCP is the largest and then becomes smaller toward the other side in the bracket arm 56*b*. In other words, a stress distribution in the area of the merging section 93 is not equal in the transverse direction. In the illustrated embodiment, even if the stress concentration caused by the burrs were to occur, the stress concentration would be relatively small, because the parting line C is deviated toward the smaller side of the stress distribution. As a result, the quality of the clamping bracket 56 can be enhanced.

A bottom end of the bracket arm 56*b* preferably has a lower pin support section 150 to pivotally support the lower pin 84 for the hydraulic tilt and trim-adjustment device 40. The lower pin support section 150 comprises a boss 152 having an aperture 154 that has an axis extending parallel to the tilt axis 74. The boss 152 is preferably positioned closer to the longitudinal center plane LCP than the remainder of the bracket arm 56*b*. The illustrated boss 152 protrudes toward the longitudinal center plane LCP from an edge line 156 of the outer flange 118. The lower pin 84 extends through the aperture 154.

As best shown in FIG. 7, the boss 137 of the trim position regulating section 130 preferably extends from the web 120 and has an end on the edge line 156 of the outer flange 118. In other words, the web 120 extends opposite to the edge line 156 in the lower part of the vertical section 90. However, the web 120 is deviated toward the longitudinal center plane LCP in the bottom portion of the vertical section 90. That is, a portion 158 of the web 120 extends along the edge line 156. A slant wall 160 connects the deviated portion 158 with an upper portion of the web 120. Thus, the part of the web 120 placed adjacent to the boss 152 is positioned closer to the longitudinal center plane LCP. The deviated portion 158 of the web 120 is positioned between the trim position regulating section 130 and the lower pin support section 150. A plurality of ribs 162 extend radially from the axis of the aperture 154 on the outer side surface of the deviated portion 158 of the web 120. Additionally, the ribs 162 are not shown in FIG. 4.

The positioning of the boss 152 and the deviated portion 158 discussed above is advantageous because the bracket assembly 34 can have larger rigidity or strength against a load or force such as, for example, an impact-induced crash induced load F1 or thrust (or propulsive force) F2. The impact induced load F1 is exerted on the swivel bracket 54 when a floating object strikes the drive unit 32 or the drive unit 32 strikes a rock. The thrust F2 is also exerted on the swivel bracket 54 whenever the propeller 38 propels the outboard motor 30. The load or force F1, F2 is exerted on the boss 152 from the cylinder 76 via the lower pin 84. Because the boss 152 and the web portion 158 are positioned closer to the cylinder 40 that extends generally on the longitudinal center plane LCP in the illustrated embodiment, the bracket assembly 34 is reinforced against the impact induced load F1 or the thrust F2.

Figure 14:
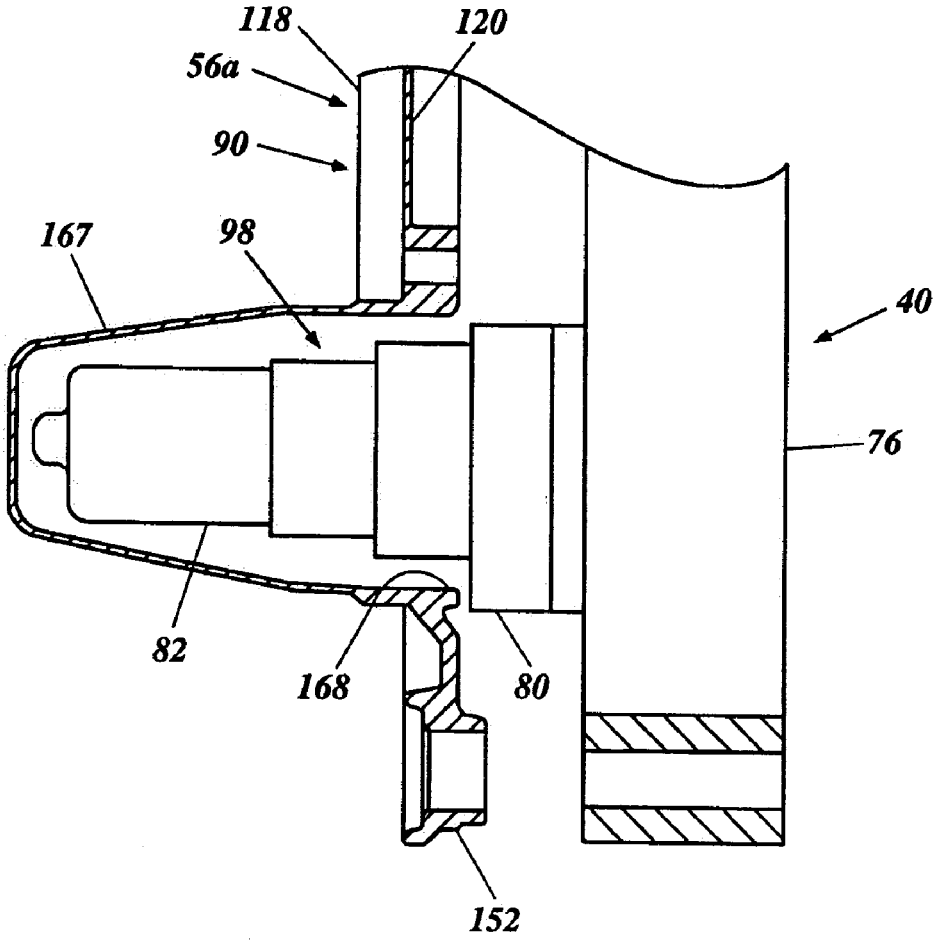
FIG. 14 illustrates a cross-sectional view of a hydraulic tilt and trim adjustment mechanism disposed in a space between the bracket arm of the clamping bracket.
Figure 15:
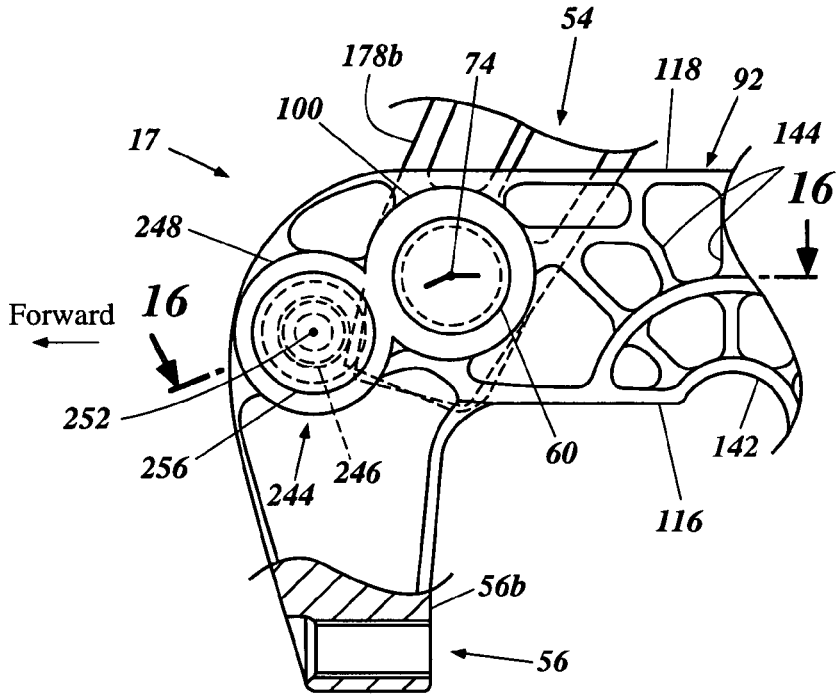
FIG. 15 illustrates a partial side elevation view of the bracket arm of the clamping bracket and the swivel bracket, particularly showing a stopper pin, with the swivel bracket placed in a fully tilted-up position.
Figure 16:
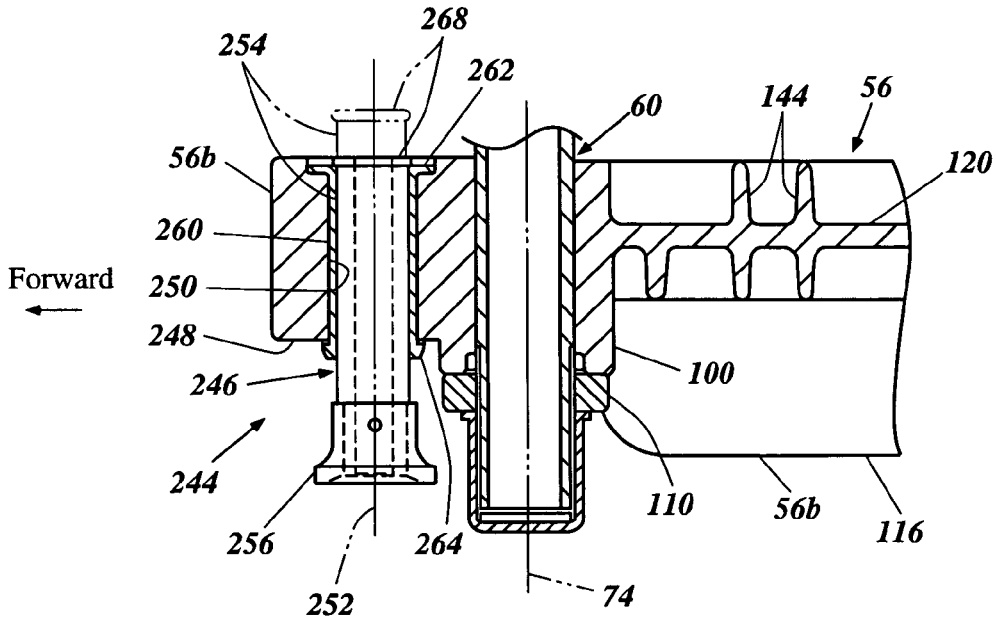
FIG. 16 illustrates a partial cross sectional view of the bracket arm and the stopper pin taken along line 16—16 of FIG. 15.
Figure 17:
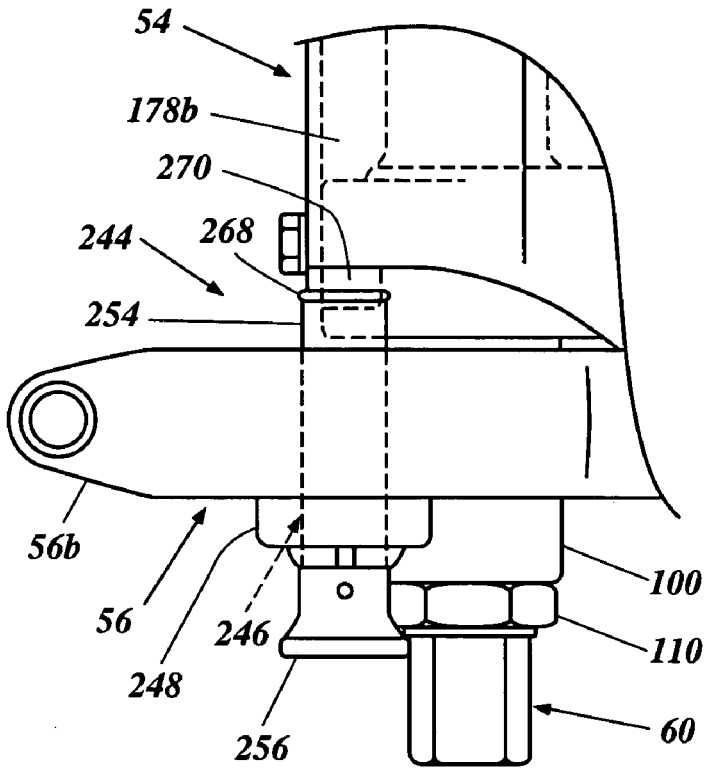
FIG. 17 illustrates a partial front view of the bracket arm and the stopper pin as seen along line 17 of FIG. 15.
Figure 18:
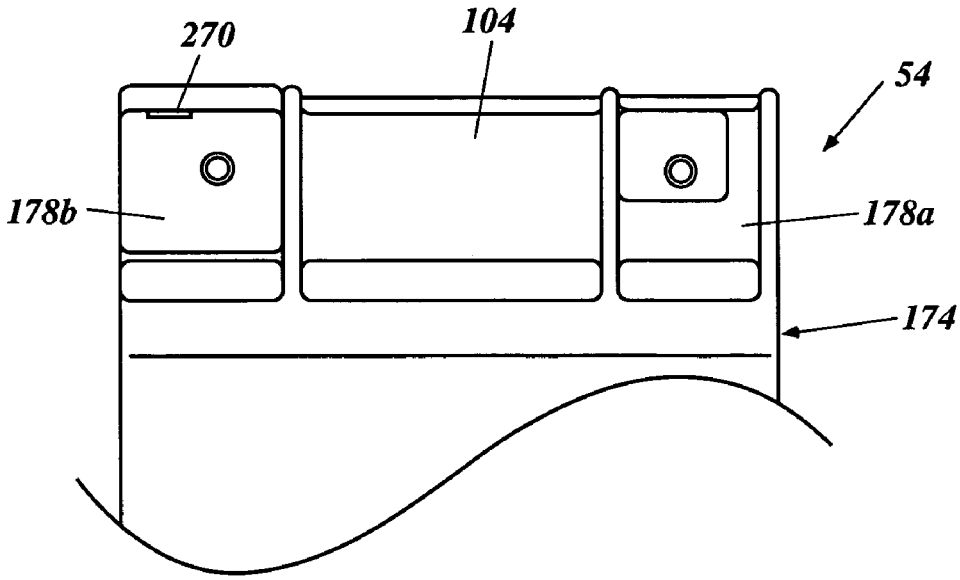
FIG. 18 illustrates a partial top plan view of the swivel bracket.
Figure 19:
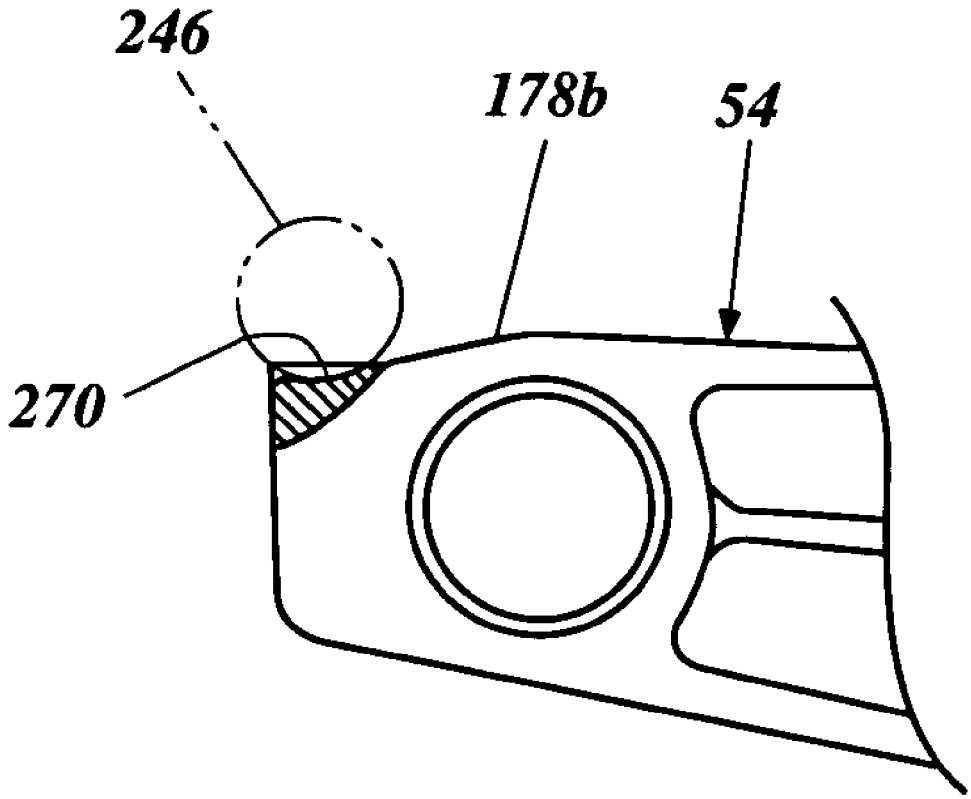
FIG. 19 illustrates a partial side elevation view of the swivel bracket, with a front end of the swivel bracket partially cross-sectioned and the stopper pin shown in phantom.

With reference to FIGS. 2, 4 and 14, the bracket arm 56*a* on the starboard side preferably has a pocket 166 to accommodate the hydraulic unit 78 of the hydraulic tilt and trim-adjustment device 40. A portion 167 of the web 120 in the vertical section 90 preferably protrudes in the opposite direction relative to the longitudinal center plane LCP to define the pocket 166. That is, the pocket portion 167 defining the pocket 166 is unitarily formed with the remainder portion of the web 120 in the vacuum die casting process. The pocket portion 167 preferably is thinner than the reminder portion of the web 120. For example, a thickness of the pocket portion 167 can be in a range between 1.0 mm and 5.0 mm; however, as these thicknesses are merely exemplary, the pocket portion 167 can also have other thicknesses. The hydraulic unit 78 extends into the pocket 166 through an opening 168. In the illustrated embodiment, almost the entire body of the electric motor 82 is positioned in the pocket 166 because the motor 82 is farther from the longitudinal center plane LCP than the hydraulic pump 80.

Preferably, the pocket portion 167 has a semi-elliptic shape which long axis generally extends on an arc that is described about the tilt axis 74. This is because the hydraulic unit 78 slightly moves about the tilt axis 74 within the pocket 166 when the tilt and trim adjustment device 40 works, and the structure can prevent the pocket 166 from hampering the movement of the hydraulic unit 78, particularly, the electric motor 82. Also, the electric motor 82 can be easily removed in the maintenance work of the tilt and trim adjustment device 40.

The pocket portion 167 formed with the web 120 in unison is strong enough against external force exerted thereon and can contribute to decreasing the weight of the bracket arm 56*a*. Also, the pocket portion 167 can reinforce the web 120 under a condition that the web 120 has the opening 168. Alternatively, however, the pocket portion 167 can be formed with a separate member made of, for example, metal or plastic. However, the metal pocket can increase the weight of the bracket arm 56*a*, and the plastic pocket may be weaker than the unitarily formed pocket 166.

With reference to FIGS. 1–3, 8–13 and 37, the swivel bracket 54 is described in greater detail below.

Similarly to the clamping bracket 56, the swivel bracket 54 is made of aluminum alloy, and is produced in the same vacuum die casting process that is used for producing the clamping bracket 56. The swivel bracket 54 is generally symmetrical relative to the longitudinal center plane LCP.

The swivel bracket 54 preferably comprises the tubular section 68 that journals the steering shaft section 58*a*, a vertical section 172, a horizontal section 174 and a merging section 176.

Preferably, the vertical section 172 extends generally vertically along the steering axis 70 and almost the entire part of the vertical section 172 is located in front of the steering axis 70. The illustrated vertical section 172 slightly lean forward relative to the steering axis 70 as shown in FIGS. 9 and 10. A lower portion of the vertical section 172 preferably intersects the steering axis 70. A width (i.e., length in the transverse direction) of the vertical section 172 is longer than the tubular section 68.

The horizontal section 174 extends generally horizontally and forward. The horizontal section 174 is bifurcated toward its forward end to form a pair of side portions 178*a*, 178*b*. The side portions 178*a*, 178*b* preferably extend parallel to each other. Respective forward ends of the side portions 178*a*, 178*b* interpose the foregoing tilt pin boss 104. In other words, the illustrated tilt pin boss 104 unitarily couples the respective side portions 178*a*, 178*b* with each other. The side portions 178*a*, 178*b* thus can be rigid and possess the necessary strength against the external force without being thicker. The pivot pin 60 extends through the side portions 178*a*, 178*b* and the tilt pin boss 104 to pivotally couple the swivel bracket 54 and the clamping bracket 56 with each other.

The vertical section 172 and the horizontal section 174 merge together in the merging section 176, similarly to those of the clamping bracket 56. In the illustrated embodiment, the side portions 178*a*, 178*b* also merge together in the merging section 176. Thus, a relatively large recess is formed among the merging section 176 and the side portions 178*a*, 178*b* of the horizontal section 174.

As described above, the steering shaft section 58*a* of the steering member 58 extends through the tubular section 68. In order to limit the pivotal movement of the steering shaft section 58*a*, the merging section 176 preferably has a pair of stoppers 182. The steering lever section portion 58*b* thus is allowed to move in a range between both the stoppers 182.

Similarly to the clamping bracket 56, the swivel bracket 54 preferably comprises an inner flange (or first flange) 184, an outer flange (or second flange) 186 and webs 188. The inner flange 184 forms an inner verge of the swivel bracket 54 and the outer flange 186 forms an outer verge thereof. Each web 188 extends between the inner and outer flanges 184, 186 of the respective side portions 178*a*, 178*b* of the horizontal section 174 to connect those flanges 184, 186 and continuously extends in the merging section 176 and the vertical section 172.

Although the entire swivel bracket 54 does not necessarily have this flange-web-flange structure, at least the merging section 176 preferably has the structure. For example, a thickness of the respective flanges 184, 186 and the web 188 is preferably in a range between 1.5 mm and 5.0 mm. The flanges and web, however, can also have other thickness. Preferably, the thickness of the inner flange 184 is equal to or larger than the thickness of the outer flange 186. Also, in the illustrated embodiment, the inner and outer flanges 184, 186 are equal in width in the transverse direction. Preferably, the inner and outer flanges 184, 186 extend parallel to the tilt axis 74, while the web 188 extends normal to the tilt axis 74.

The web 188 on the horizontal section 174, the merging section 176 and a top part of the vertical section 172 preferably has a plurality of ribs 190. Preferably, some of the ribs 190 extend between the inner and outer flanges 184, 186 and generally radiate from a portion of the inner flange 184 in the merging section 176, while other ribs 190 extend generally normal to the radially disposed ribs 190 to form an arc or arcs. That is, the ribs 190 preferably extend in the area of the web 188 as a net-like structure. The ribs 190 generally extend parallel to the tilt axis 74.

As best shown in FIG. 11, the inner flange 184 of the vertical section 172 preferably defines a pair of side flange portions 194 and a center flange portion 196. The respective side flange portions 194 extend along each side edge line of the vertical section 172 to be spaced apart from each other in the transverse direction. The respective webs 188 extend forward toward the side portions 178*a*, 178*b* from the respective side flange portions 194. The side flange portions 194 are coupled with each other in the merging section 176. The center flange portion 196 connects both of the side flange portions 194 with each other and extends in front of the tubular section 68. As shown in FIGS. 8, 9, 11 and 13, an inner reinforcing rib 200 preferably extends to the tubular section 68 from a lower end of the center flange portion 196 to connect the inner flange 172 of the vertical section 90 with the tubular section 68. The inner reinforcing rib 200 is preferably tapered downward.

As shown in FIGS. 8–11, the forgoing stopper sections 138, which can abut on the associated trim position regulating pins 136, generally protrude forward from the side flange portions 194. Each stopper section 138 is preferably positioned in an area of each side flange portion 194 located next to the center flange portion 196. Also, each top portion T of the stopper sections 138 is preferably positioned to meet the side edge line of the inner flange 184. The side flange portions 194 and the center flange portion 196 are connected with each other through channel areas 202. The areas of the flange portions 194, 196 and the channel areas 202 make a substantially flush surface. The top portion T of each stopper section 138 preferably has a width W1 which is nearly a half of a width W of the side flange portion 194. Preferably, the entire width of the illustrated stopper section 138 is generally equal to the width W. In other words, the remainder portion of stopper section 138 other than the top portion T, i.e., a down slope portion thereof, extends with a width W2, as seen in FIG. 11.

As shown in FIGS. 2, 8–11 and 37, the swivel bracket 54 preferably has an upper pin support section 206. The illustrated upper pin support section 206 comprises a pair of bosses 208 positioned just above the respective side flange portions 194. In the illustrated embodiment, the foregoing ribs 190 are formed around the bosses 208.

Figure 37:
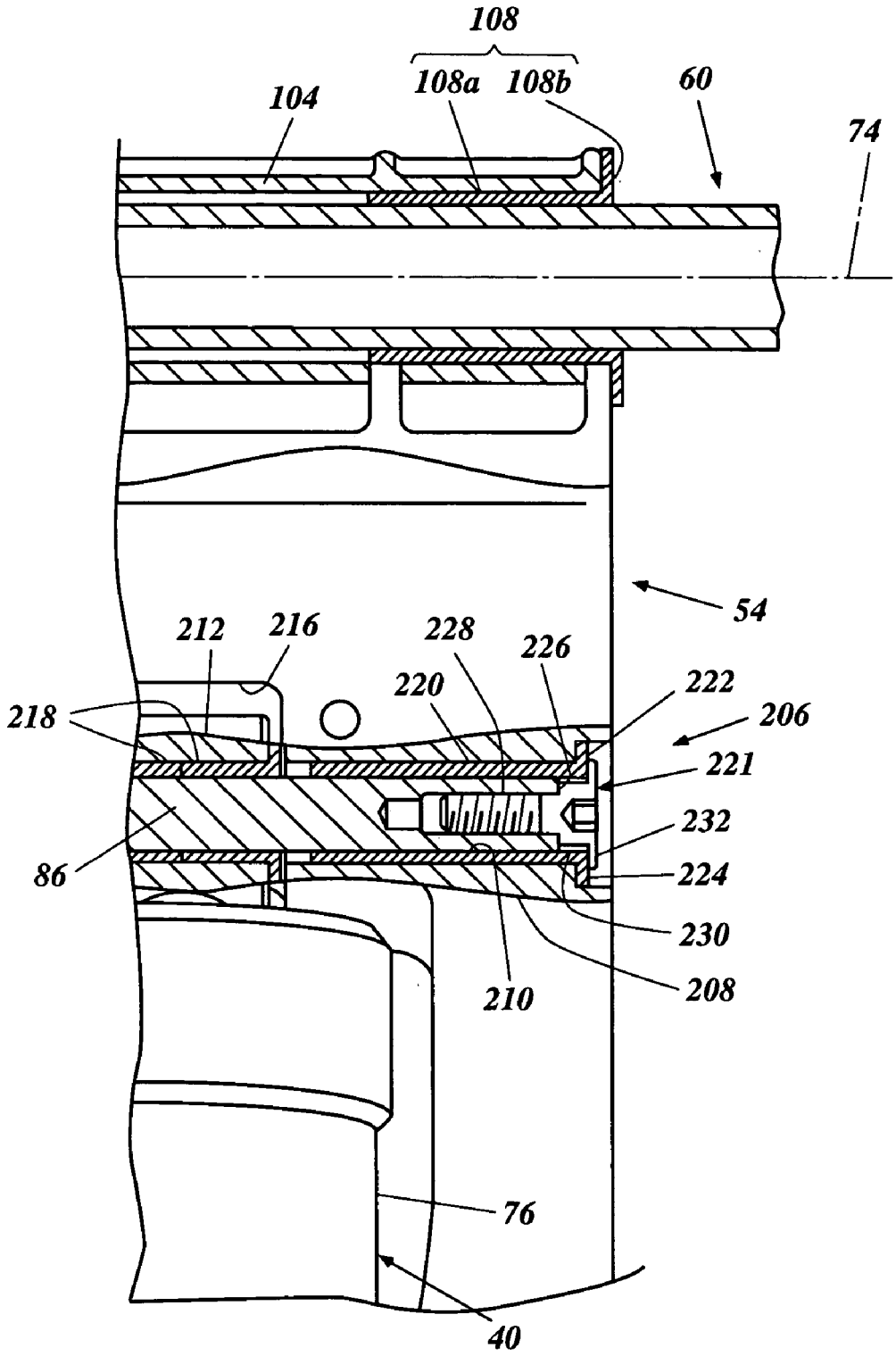
FIG. 37 illustrates an enlarged partial front, cross-sectional view of the bracket assembly.

As best shown in FIGS. 2 and 37, the respective bosses 208 define apertures 210 extending coaxially. The apertures 210 also extend generally horizontally and parallel to the tilt axis 74. The bosses 208 interpose a head portion 212 of the piston rod. The head portion 212 also has an aperture that extends coaxially with the apertures 210 of the bosses 208. The upper pin 86 extends through the apertures 210 of the bosses 208 and the aperture of the head portion 212 of the piston rod. The upper pin support section 206 of the swivel bracket 54 pivotally supports the piston rod via the upper pin 86. The swivel bracket 54 preferably has a recess 216 to receive the head portion 212 of the piston rod. The recess 216 preferably has a space that can receive an upper portion of the cylinder 76 particularly while the swivel bracket 54 is placed in the trim adjustment range θ1.

In the illustrated embodiment, still with reference to FIGS. 2 and 37, a pair of bushings 218 are inserted between the head portion 212 of the piston rod and the upper pin 86. Each bushing 218 preferably has a flange so that these flanges can transversely interpose the head portion 212 of the piston rod. Another pair of bushings 220 are inserted between the respective bosses 208 and the upper pin 86. Allen bolts or set screws 221 preferably are used to securely fix the bushings 220 in position. That is, each boss 208 has a seat 222 on its side end, while each bushing 220 has a flange 224 that can be retained by the seat 222. The illustrated upper pin 86 has a length that is slightly shorter than a width of the swivel bracket 54. Each side end 226 of the upper pin 86 thus does not reach the flange 224 of the bushing 220. The upper pin 86 preferably has a threaded recess that extends along an axis 227 of the upper pin 86. Each Allen bolt 221 has a threaded portion 228, a head portion 230, a flange portion 232 and a hexagonal hole. The threaded portion 228 is screwed into the threaded recess of the upper pin 86 using a hexagonal wrench. Thus, the head portion 230 is fitted into the bushing 218 and the flange portion 232 abuts on the flange 224 of the bushing 218. The flange portions 232 of the respective Allen bolts 221 surely keep the bushings 218 in position, accordingly.

Because each entire body of the Allen bolts 221 can be completely housed in a space defined around the aperture 210 in the upper pin holding structure described above, a space S (FIG. 2) between the swivel bracket 54 and the respective bracket arms 56*a*, 56*b* of the clamping bracket 56 can be narrowed enough. The length of the tilt pin 60 thus can be short enough to make the bracket assembly 34 be compact. In addition, because the space S is narrowed, the stopper sections 138 can be formed within the area of the inner flange 184 and thus partial stress concentration can be relieved. As a result, the stopper sections 138 can be so slimmed that the whole weight of the bracket assembly 34 can be decreased.

As shown in FIGS. 8, 9, 12 and 13, outer reinforcing ribs 236 preferably extend to the tubular section 68 from a lower end of the outer flange 186 to connect the outer flange 186 of the vertical section 172 with the tubular section 68. The outer reinforcing rib 236 is tapered downward similarly to the inner reinforcing rib 200.

As thus described, the swivel bracket 54 and the clamping bracket 56 in the illustrated embodiment basically has the flange-web-flange structure. The geometrical moment of inertia (or second moment of area) thus can be large relative to the weight thereof. The outboard motor 30 can be light and compact even though the bracket assembly 34 keeps necessary rigidity or strength. Also, the vacuum die casting process can be used to produce the illustrated swivel bracket 54 and clamping bracket 56. This method allows some selected portions to be thicker than other portions. Thus, only portions that require more rigidity or strength can have a thicker structure. In other words, the flange-web-flange structure can have greater advantages when the swivel bracket 54 or the clamping bracket 56 is produced using the vacuum die casting method. In addition, the vacuum die casting process can form a high-strengthened chilled layer over the entire surface of the swivel bracket 54 or the clamping bracket 56 by the chill affect.

Figure 8:
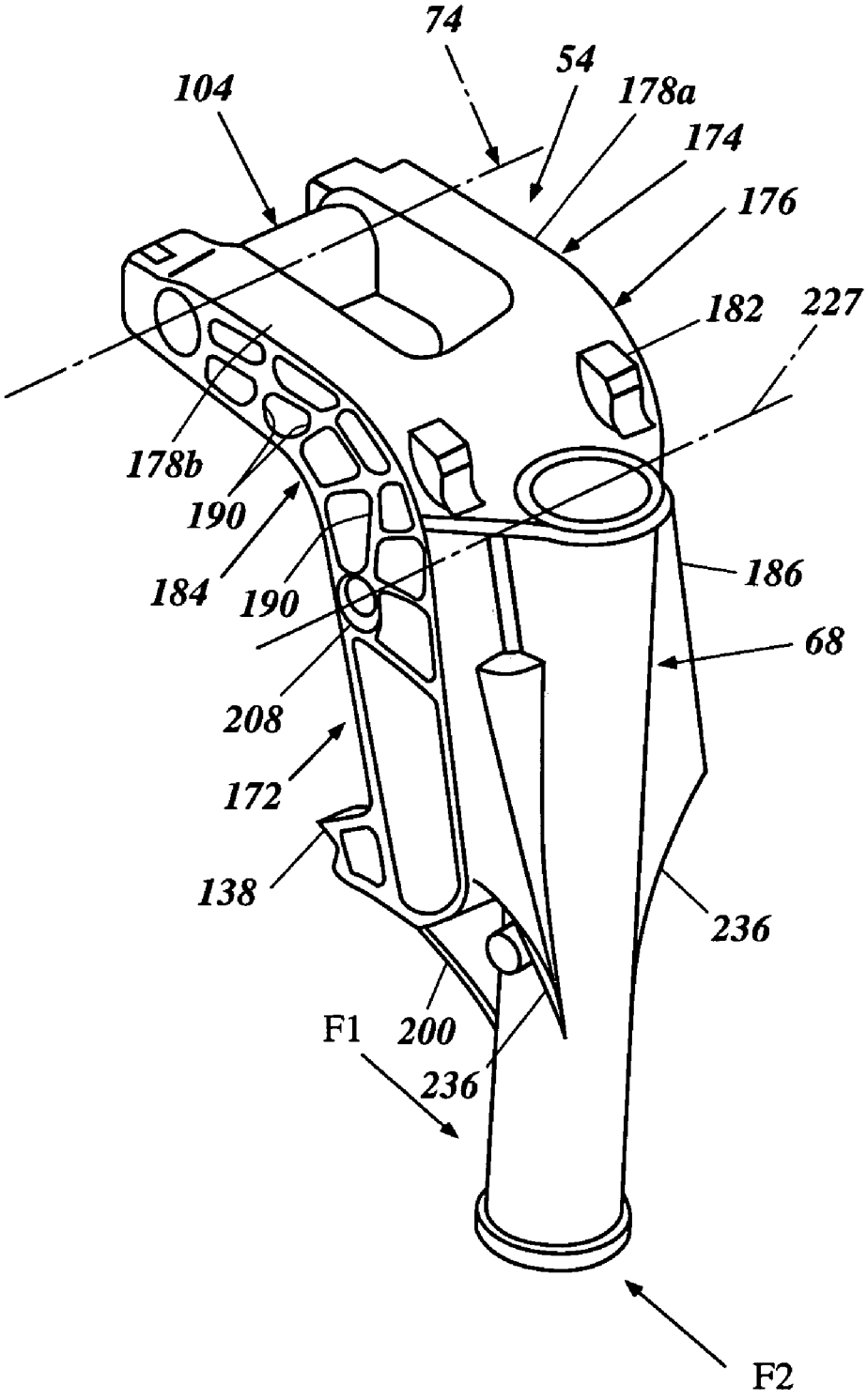
FIG. 8 illustrates a perspective view of a swivel bracket of the bracket assembly of FIG. 2.

With reference to FIGS. 5, 8 and 9, the foregoing impact-induced load F1 can be exerted on the swivel bracket 54 when a floating object strikes the drive unit 32 or the drive unit 32 runs into a rock. The thrust or propulsive force F2 is also exerted on the swivel bracket 54 whenever the propeller 38 propels the outboard motor 30. In general, the impact-induced load F1 is greater than the thrust F2. The tilt and trim adjustment device 40 absorbs the shock or the impact-induced load F1 under a crash condition because the device 40 has the shock absorbing mechanism. However, the swivel bracket 54 receives the full force of the impact-induced load F1. Thus, the swivel bracket 54 primarily needs to endure the impact-induced load F1. On the other hand, because the clamping bracket 56 does not directly receive the impact-induced load F1, the clamping bracket 54 primarily needs to endure the thrust F2.

Under a normal running condition, the thrust force F2 is likely to rotate a portion of the swivel bracket 54 around the upper pin 86 clockwise in the view of FIG. 9. Because the portion of the swivel bracket 54 around the upper pin 86 rotates clockwise, the tilt pin 60 is also likely to rotate clockwise in the view of FIG. 5. The vertical section 90 of the clamping bracket 56 abuts on the watercraft transom 36*a*, the movement of the tilt pin 60 gives a relatively large tensile stress f1 to the inner flange 116 and also gives a relatively large compressive stress f2 to the outer flange 118. In the illustrated embodiment, the flange-web-flange structure of the clamping bracket 56 can bear the stresses f1, f2 for the structure. The clamping bracket 56 thus can endure the relatively large thrust F2. In addition, because the vacuum die casting method is used in the illustrated embodiment, the chilled layer of the clamping bracket 56 also contributes to improving the rigidity or strength thereof.

On the other hand, as shown in FIG. 9, the impact-induced load F1 gives a relatively large tensile stress f3 to the inner flange 184 of the swivel bracket 54 and also gives a relatively large compressive stress f4 to the outer flange 186 of the swivel bracket 54. In the illustrated embodiment, the flange-web-flange structure of the swivel bracket 54 can bear the stresses B3, f4 for the structure similarly to the situation of the clamping bracket 56. The swivel bracket 54 thus can endure the relatively large impact-induced load F1. The chilled layer of the swivel bracket 54 also contributes to improving the rigidity or strength thereof.

If the outboard motor 30 does not incorporate the shock absorbing mechanism, the clamping bracket 56 directly receives the crash induced load F1. Under even such a condition, the flange-web-flange structure and the chilled layer of the clamping bracket 56 can work effectively. Also, the swivel bracket 54 of course receives the thrust F2 even though the thrust F2 is less than the impact-induced load F1. The flange-web-flange structure and the chilled layer of the swivel bracket 54 also can work effectively against the thrust F2.

It should be noted that either the swivel bracket or the clamping bracket can take other structures other than the flange-web-flange structure. Also, both of the swivel bracket and the clamping bracket, or either the swivel or clamping bracket can be produced in methods other than the vacuum die casting.

As noted above, the upper area of the inner flange 116 of the clamping bracket 56 is generally wider than the remainder area (i.e., lower area) in the illustrated embodiment. This is advantageous not only for the clamping bracket 56 to surely grasp the transom 36*a* but also to endure the tensile force f1 exerted onto the inner flange 116.

In the illustrated embodiment, the inner reinforcing rib 200 and the outer reinforcing rib 236 of the swivel bracket 54 advantageously enhance the strength of the tubular section 68 which receives the bending moment caused by the crash induced load F1 and the thrust F2. That is, the illustrated inner and outer reinforcing ribs 200, 236 continuously extend from the inner flange 184 and the outer flange 186, respectively, to be spaced apart from the center of the second moment of inertia. Those reinforcing ribs 200, 236 thus can increase the second moment of inertia to realize the thinner flange-web-flange structure.

Also, the arrangement of the stopper sections 138 is advantageous because the stopper sections 138 do not need any reinforcement that can make the stopper sections 138 large. That is, each stopper section 138 is positioned in the area of the respective side flange portions 194. In addition, each side flange portion 194 and the center flange portion 200 are connected with each other through the channel area 202 in the illustrated embodiment. The load that is given to each stopper section 138 thus can be dispersed to the neighboring side flange portion 194 and the center flange portion 196. As a result, excessive stress concentration to the stopper sections 138 can be avoided. That is, the impact-induced load F1 transfers to the shock absorbing mechanism from the lower end portion of the tubular section 68 through the center flange portion 200 and the respective side flange portions 194. Thus, the stopper sections 138 are located in the transfer route of the crash induced load F1. Because of this arrangement, unless at least the down slope portion of each stopper section 138 that has the width W2 is positioned in the area of each side flange portion 194, the stopper section 138 need to receive the large induced load F1 and inevitably needs to have large mass. The down slope portion, and the channel area 202 in addition to the down slope portion, can contribute to decreasing the mass of each stopper section 138.

In addition, the ribs 144 of the clamping bracket 56 and the ribs 190 of the swivel bracket 54 in the illustrated embodiment can inhibit the stress concentration in the clamping and swivel brackets 56, 54. Also, the ribs 144, 190 can improve flow of the molten metal around the ribs 144, 190 in the vacuum die casting process and contribute to enhancing the construction quality of the clamping and swivel brackets 56, 54.

Further, as discussed above, the thickness of the inner flange 116, 184 preferably equals to or greater than the thickness of the associated outer flange 118, 186. The clamping bracket 56 and the swivel bracket 54 can sufficiently endure the tensile stress f1, f3, respectively. Particularly, the tensile stress f3 of the swivel bracket 54 is extremely large, and the thicker inner flange 184 of the swivel bracket 54 is quite useful.

Additionally, the flange-web-flange structure is quite suitable to the vacuum die casting process. However, other processes are of course applicable for producing the swivel bracket 54 and the clamping bracket 56, as noted above.

With reference to FIGS. 1–3, 15–19 and 28, the swivel bracket 54 together with the drive unit 32 can be held at the fully tilted up position while, for example, the associated watercraft 36 stays in harbor. That is, the swivel bracket 54 can be generally placed at the fully tilted up position in the tilt range θ2 of FIG. 28 so that the propeller 38 is out of the body of water. The bracket assembly 34 preferably has a tilted up position holding mechanism 244 between the swivel bracket 54 and the clamping bracket 56 to hold the swivel bracket 54 at the fully tilted up position.

The tilted up position holding mechanism 244 preferably comprises a stopper to hold the swivel bracket 54. In the illustrated embodiment, the stopper is a cylindrical stopper pin 246 positioned opposite to the steering axis 70 relative to the tilt axis 74. Preferably, the bracket arm 56*b* on the port side has a stopper boss 248 located in front of the tilt axis 74 and slightly lower than the tilt axis 74. The stopper boss 248 preferably defines an aperture 250 extending generally horizontally and transversely. The stopper pin 246 extends through the aperture 250. The stopper pin 246 preferably has a pin axis 252 extending generally parallel to the tilt axis 74.

The stopper pin 246 is axially movable between an extended position and a retracted position. The stopper pin 246 can extend out of the aperture 250 and a tip end 254 thereof projects toward the longitudinal center plane LCP when the stopper pin 246 is placed in the extended position. On the other hand, the stopper pin 246 can be retracted into the aperture 250 so that the entire tip end 254 is placed within the aperture 250 when the stopper pin 246 is placed in the retracted position.

The operator can manually operate the stopper pin 246 along the pin axis 252. The illustrated stopper pin 246 has a knob 256 on the other end of the pin 246 that is located opposite to the tip end 252. The operator thus can move the stopper pin 246 by picking the knob 256 up with his or her fingers.

In the illustrated embodiment, a cylindrical collar 260 is disposed within the aperture 250 to support the stopper pin 246. The collar 260 preferably has a center side flange 262 and an outer side flange 264 on both ends. The bracket arm

56*b* preferably has a recess on the surface positioned closer to the longitudinal center plane LCP. The center side flange 262 of the collar 260 is placed in the recess. The outer side flange 264 engages the other surface of the bracket arm 56*b*. Thus, the collar 260 is kept in the aperture 250 and is not movable axially.

The illustrated stopper pin 246 has a center side flange 268 that has an outer diameter larger than a body of the stopper pin 246. The knob 256 is preferably separable from the body of the stopper pin 246. The stopper pin 246 is inserted into the aperture 250 from an opening of the aperture 250 located on the surface of the bracket arm 56*a* closer to the longitudinal center plane LCP. The center side flange 268 of the stopper pin 246 engages the center side flange 262 of the collar 260. Under the condition, the knob 256 is coupled with the body of the stopper pin 246 by a fastener such as, for example, a set screw. The stopper pin 246 thus is prevented from slipping off from the aperture 250.

A forward end of the side portion 178*b* of the swivel bracket 54 preferably has a groove 270. The center side flange 268 of the stopper pin 246 can engage the groove 270. Under the condition that the center side flange 268 engages the groove 270, the stopper pin 246 can be kept in the extended position.

The operator operates the tilt and trim adjustment device 40 to lift up the swivel bracket 54 together with the drive unit 32 to the fully tilted up position. When the swivel bracket 54 and the drive unit 32 reach the fully tilted up position, the operator operates the knob 256 of the stopper pin 246 to the extended position. The forward end of the side portion 178*b* of the swivel bracket 54 thus abuts on the tip end 254 of the stopper pin 246 and the center side flange 268 engages the groove 270 of the swivel bracket 54. Because the swivel bracket 54 is prevented from pivoting clockwise in the view of FIG. 15 under the condition, the swivel bracket 54 and the drive unit 32 can be held in the fully tilted-up position.

The forward portion of the bracket arm 56*b*, however, is less affected by the impact-induced load F1 or the thrust F2. Thus, the forward portion does not need a particular reinforcement, or further the forward portion can be even thinner than a conventional structure (for example, thinner than the structure disclosed in JP-U-1-10320A). The bracket arm 56*b* can be light and compact, accordingly. In addition, the operator can easily operate the stopper pin 246 from the stem of the associated watercraft 36 because the stopper pin 246 is closer to the operator than being positioned between the steering axis 70 and the tilt axis 74.

With reference to FIGS. 1 and 20–27, the upper and lower mounts 64, 66 and structures around those mounts 64, 66 are described below.

As discussed above, the steering member 58 is affixed to the upper casing 48. The illustrated steering member 58 has a pair of mount arms 274 extending generally horizontally rearward from a top end of the steering shaft section 58*a*. Each mount arm 274 preferably has the upper mount 64 that is resiliently affixed to an upper portion of the upper casing 48. The illustrated mount arms 274 also resiliently fix the exhaust guide 52 to the upper casing 48.

A bottom end 276 of the steering shaft section 58*a* preferably protrudes downward beyond a bottom end of the tubular section 68 of the swivel bracket 54. A lower mount housing 278 is preferably coupled with the bottom end 276 of the steering shaft section 58*a*. The lower mount housing 278 incorporates a pair of the lower mounts 66. The lower mounts 66 are resiliently affixed to a lower portion of the upper casing 48. The illustrated lower mount housing 278 is made of aluminum alloy.

As best shown in FIG. 22, each lower mount 66 preferably comprises an outer tube 280, an inner tube 282 and a resilient member 284 connecting the outer and inner tubes 280, 282 with each other. The resilient member 284 is made of a hard elastic material such as, for example, a hard rubber. The resilient member 284 is rigidly fixed to the outer and inner tubes 282. FIG. 22 generally illustrates one of the lower mount 66 positioned on the port side. The lower mount 66 can represent both of the lower mounts 66 in the description because the other one is the axial symmetry with the lower mount 66 of FIG. 22.

The upper casing 48 preferably has a pair of recessed portions 286 on both front and side ends thereof. Each recessed portion 286 encloses the respective lower mount 66 therein. The upper casing 48 also defines a vertically extending aperture 288 on the longitudinal center plane. The driveshaft extends through the aperture 288. A mount cover 289 is detachably affixed to the upper casing 48 around each recessed portion 286 to cover the recessed portion 286 and also each lower mount 66.

The lower mount housing 278 extends in front of the upper casing 48 and preferably comprises a forward section 290 and a rear section 292 which are separable from one another. The forward and rear sections 290, 292 together interpose the bottom end of the steering shaft section 58*a*. Multiple bolts 293 (for example, four bolts in the illustrated embodiment) rigidly couple the forward and rear sections 290, 292 and the bottom end of the steering shaft section 58*a*. The forward section 290 defines a vertically extending aperture through which the bottom end of the steering shaft section 58*a* extends. The rear section 292 preferably defines a pair of bosses 292*a* that has an aperture 294 extending generally horizontally and fore to aft. A coupling bolt 298 extends through the aperture 294 and the inner tube 282 on each side to couple the lower mount housing 278 and the lower mount 66 with each other. In the illustrated embodiment, the bolts 293 and the coupling bolt 298 extend parallel to each other. Thus, the lower portion of the swivel bracket 54 is resiliently coupled with the lower portion of the upper casing 48 via each resilient member 284 of the respective lower mounts 66.

In the illustrated embodiment, the bottom end of the steering shaft section 58*a* has a polygon shape such as, for example, an octagonal shape as partially shown in FIG. 22. The forward and rear sections 290, 292 also have the same polygon shape. Thus, the steering movement of the steering member 58 is surely transferred to the drive unit 32.

The forward section 290 of the lower mount housing 278 preferably has a pair of bosses 300 generally below the major part of the forward section 290. The illustrated bosses 300 are unitarily formed with the major part of the forward section 290. Each boss 300 preferably has a bolt hole 302 extending generally horizontally and parallel to the aperture 294. The bolt hole 302 opens forward.

An upper portion of the lower casing 50 preferably has an anti-cavitation plate 306 for inhibiting cavitation from occurring. The anti-cavitation plate 306 is a unitarily formed flange extending generally horizontally forward and on both sides. A lower portion of the upper casing 48 preferably has a splash guard for preventing splash raised while traveling from entering the upper casing 48 or the lower casing 50. The splash guard preferably includes a splash plate 308 of the upper casing 48. The splash plate 308 is a unitarily formed flange that is positioned just above the cavitation plate 306 and extends generally horizontally forward and on both sides of the upper casing 48.

The splash guard also includes a lower mount cover 310 that forms the major part of the splash guard. The lower mount cover 310 is made of aluminum alloy and is produced in the vacuum die casting process described above. A thickness of the mount cover 310 preferably is approximately 1.5 mm. The lower mount cover 310, however, can be produced in other methods.

The lower mount cover 310 preferably comprises a cover section 312 and an eaves section 314 both unitarily formed with each other. The cover section 312 generally covers a front surface and side surfaces of the lower mount housing 278. The cover section 312 further comprises a body portion 316 and a foot portion 318. The body portion 316 is preferably curved forward and generally surrounds the front and side surfaces of the lower mount housing 278. Outer surfaces of both rear ends 320 of the body portion 316 are generally flashed with corresponding outer surfaces of the mount covers 289.

The body portion 316 preferably has a pair of recesses 322 that can abut on respective forward surfaces of the bosses 300 of the lower mount housing 278. Each recess 322 has an aperture 324 that corresponds to the respective bolt hole 302. Bolts 326 are screwed into the aperture 324 and the bolt holes 302 to detachably couple the lower mount cover 310 to the lower mount housing 278.

The foot portion 318 preferably extends from a lower end of the body portion 316. The illustrated foot portion 318 is slightly reduced in size relative to the body portion 316 to form a step between the body portion 316 and the foot portion 318. The foot portion 318 is slightly spaced apart from a top surface of the splash plate 308.

The eave section 314 is a flange that generally extends above the front cover section 312 and forward relative to the body portion 316 of the front cover section 312. That is, a bottom surface 328 of the eave section 312 extends generally horizontally and parallel to the splash plate 312 to oppose thereto. A top surface 330 of the eave section 314 preferably has a recessed portion 332 that opens rearward. The tubular section 68 is positioned at the forward-most end of the recessed portion 332. The top surface 330 preferably extends upward rearward. Because the bottom surface 328 extends horizontally, an inner cavity 334 is formed between the lower and upper surfaces 328, 330. Both sides 336 of the top surface 330 are sloped downward toward the bottom surface 328.

As thus constructed, the splash guard can effectively guard the upper casing 48 and the lower casing 50 from splash. More specifically, the splash raised by the stem of the watercraft 36 or the lower casing 50 can be inhibited from entering the upper or lower casing 48, 50 or the watercraft 36 not only by the splash plate 308 but also by the eave section 314 of the lower mount cover 310.

The illustrated lower mount cover 310 is detachably affixed to the lower mount housing 278 as discussed above. Thus, the lower mount cover 310 can be easily detached from the lower mount housing 278 in the event, for example, that the lower mount cover 310 is damaged by a floating object such as, for example, a piece of driftwood. Particularly, the detachable lower mount cover 310 is quite useful under, for example, a condition that the lower mount housing 278 adheres to the bottom end of the steering shaft section 58*a* by electrolytic corrosion.

Because the top surface 330 of the mount cover 310 has the recessed portion 332 to surround the bottom end of the steering shaft section 58*a* rather than having an aperture, attaching work or detaching work of the mount cover 310 can be further easier.

Also, because the cover section 312 and the eave section 314 are unitarily formed in the illustrated embodiment, no space is made between both of the sections 312, 314. Even though relatively large dynamic pressure by the splash is exerted upon the bottom surface 328 of the cave section 314, the splash is surely prevented from entering the upper or lower casing 48, 50 through the inner cavity 334.

Further, the lower mount cover 310 in the illustrated embodiment is produced in the vacuum die casting process. The mount cover 310 thus can keep sufficient rigidity or strength against dynamic pressure even though the thickness thereof is only approximately 1.5 mm. The mount cover 310 can contribute to compactness of the outboard motor 30 and also to decreasing weight of the outboard motor 30. In addition, the vacuum die casting process allows to select wide variety of configurations. Thus, the lower mount cover 310 can enjoy the foregoing effects at no sacrifice of its external appearance.

With reference to FIGS. 1–3 and 28–37, a trim and tilt position sender mechanism 340 is described below.

The trim and tilt position sender mechanism 340 is disposed between the swivel bracket 54 and the clamping bracket 56 to detect a trim position, i.e., a tilt angle of the swivel bracket 54 relative to the clamping bracket 56. The trim and tilt position sender mechanism 340 preferably comprises a drive gear 342 attached to the swivel bracket 54, a driven gear 344 attached to the clamping bracket 56 and a sender body 346. The illustrated sender body 346 is attached to the clamping bracket 56.

The drive gear 342 is preferably mounted on the tilt pin 60 to pivot with the movement of the swivel bracket 54 relative to the tilt pin 60. A pivot axis of the drive gear 342 is preferably consistent with the tilt axis 74. The driven gear 344 is mounted on a shaft 348 of the sender body 346. The drive gear 342 and the driven gear 344 engage with each other so that the drive gear 342 drives the driven gear 344 when the swivel bracket 54 pivots about the tilt axis. The sender body 346 preferably incorporates a position sensor such as, for example, a potentiometer therein. The shaft 348 is a part of the position sensor. Because the shaft 348 rotates together with the driven gear 344, the position sensor detects a tilt angle of the swivel bracket 54.

In the illustrated embodiment, the flange portion 106*b* of the bushing 106 forms the drive gear 342. The bracket arm 56*a* of the clamping bracket 56 preferably defines a recess 350 to enclose the flange portion 106*b*, i.e., the drive gear 342. The drive gear 342 has teeth 352 on its outer periphery. The teeth 352 are not formed on the entire periphery but are formed generally in a range corresponding to the range of the tilt and trim adjustment movement ($\theta 1+\theta 2$) of the swivel bracket 54.

Because the flange portion 106*b* of the bushing 106 forms the drive gear 342, no other member is necessary for the drive gear 342 and the outboard motor 30 can be compact, particularly in the transverse direction, and also can be economically produced.

The drive gear 342 also has a pin 356 extending toward the tilt pin boss 104 of the swivel bracket 54. The tilt pin boss 104 has a recess 358 that receives the pin 356 of the drive gear 342. The drive gear 342 thus can pivot with the pivotal movement of the swivel bracket 54. Because the entire body of the drive gear 342, which has a certain thickness, is enclosed within the recess 350, the bracket assembly 34 can keep its compactness in the transverse direction. In other words, the bracket assembly 34 does not need to be elongated in the transverse direction.

Also, in the illustrated embodiment, the driven gear 344 is placed at a location in front of the tilt axis 74. More specifically, the driven gear 344 is positioned more forward than the tilt axis 74 and lower than the tilt axis 74. The driven gear 344 is preferably affixed to the shaft 348 of the sender body 346 via a bias spring 366. The spring 366 always urges the shaft 348 toward its initial position.

Figure 33:
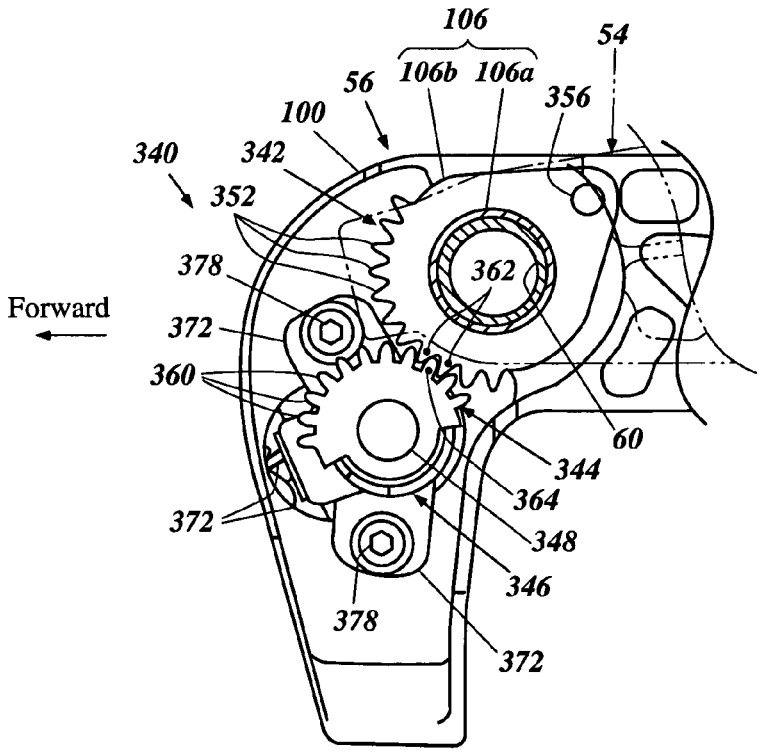
FIG. 33 illustrates another side elevation view (port side view) of the trim and tilt position sender mechanism without the cover.

The driven gear 344 has teeth 360 that engage with the teeth 352 of the drive gear 342. As shown in FIG. 33, the drive gear 342 preferably has a pair of positioning marks 362, while the driven gear 344 have a positioning mark 364. The illustrated positioning marks 362, 364 are dots. Normally, the teeth 352 having the marks 362 interpose the tooth 360 having the mark 364. Under this condition, the drive gear 342 and the driven gear 344 engage together in a standard phase relationship.

A forward portion of the tilt pin boss 100 of the clamping bracket 56 preferably defines a recess 370 communicating with the recess 350. The illustrated recess 370 is larger than the recess 350. The recess 370 encloses the sender body 346 therein. The recess 370 preferably defines an opening 371 through which lead wires 372 for the position sensor extend out. The lead wires 372 are preferably connected to a trim and tilt position indicator (not shown) disposed in a cockpit or on a display panel of the watercraft 36 to indicate the detected tilt position. Additionally, the position sensor in the sender body 346 can send a linearly sequential signal or a non-linearly sequential signal over the entire trim and tilt range to the indicator. Also, a control device can use the signal of the position sensor for controlling an engine operation, the tilt and trim adjustment device 40 or other devices of the outboard motor 30.

The recess 370 and the foregoing recess 350 are positioned in the forward portion or the portion around the tilt pin 60. Because those portions experience less stress under an impact-induced load F1 or the thrust F2, the recesses 350, 370 do not reduce the rigidity or strength of the bracket arm 56*a*.

Figure 34:
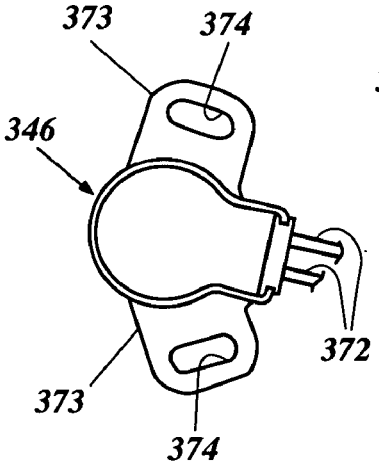
FIG. 34 illustrates a side elevation view of a sender body with a driven gear of the trim and tilt position sender mechanism.
Figure 35:
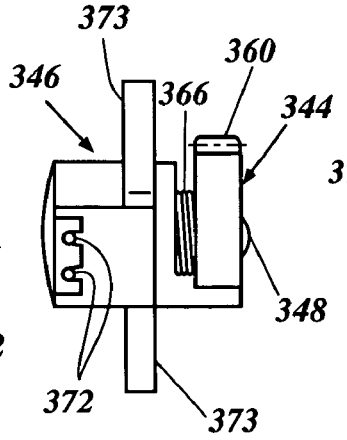
FIG. 35 illustrates a front view of the sender body with the driven gear.
Figure 36:
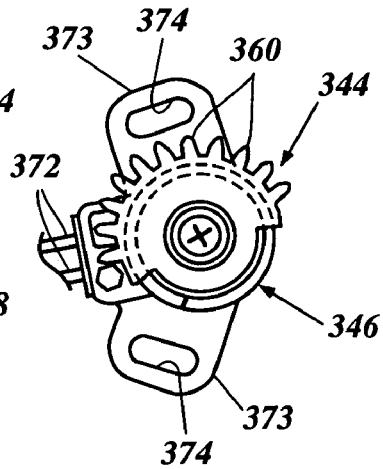
FIG. 36 illustrates another side elevation view of the sender body with the driven gear.

The sender body 346 preferably has a pair of arms 373 extending generally normal to the pivot axis of the shaft 348. Each arm 373 preferably has a slot 374 (FIGS. 34–36). The tilt pin boss 100 also defines a seat surface 376 having a pair of bolt holes. The arms 373 of the sender body 346 abuts on the seat surface 376 and bolts 378 are screwed into the bolt holes to fix the sender body 346 to the tilt pin boss 100. Because of the slots 374, a position of the sender body 346 is adjustable before the bolts 378 are firmly screwed up to set the teeth 352, 360 in the standard phase relationship or other phase relationships. In addition, because the driven gear 344 is positioned in front of the tilt axis 74, the operator can easily adjust the phase relationships of the drive and driven gears 342, 344 without leaning forward.

A cover 380 preferably covers the driven gear 344 and the sender body 346. The cover 380 extends opposite to the recess 370 and closer to the longitudinal center plane LCP than the recess 370. That is, the cover 380 is generally shaped to extend along an external form of the forward portion of the bracket arm 56*a*. The cover 380 preferably has a boss 382 in the forward-most end thereof. The boss 382 is detachably affixed to the forward portion of the bracket arm 56*a* using fasteners such as, for example, clips 384. A distal end of the illustrated cover 380 is slightly spaced apart from the opposing portions of the bracket arm 56*a* and the tilt pin boss 104 of the swivel bracket 54.

As thus constructed, the illustrated sender mechanism 340 is located in the forward portion of the bracket arm 56*a* and around the tilt pin 60 where the crash induced load F1 or the thrust F2 do not affect. Thus, the sender mechanism 340 can contribute to compactness of the outboard motor 30 and also to decreasing weight of the outboard motor 30. The illustrated sender mechanism 340 is quite simple because the mechanism 340 only needs the drive and driven gears 342, 344 and the sender body 346. The illustrated sender mechanism 340 can be kept from mischief and also can maintain the aesthetics of the outboard motor 30 because the sender mechanism 340 is almost entirely enclosed in the recesses 350, 370 and covered by the cover 380. Also, the cover 380 can prevent foreign substances from entering between the teeth 352, 360. The position sensor in the sender body 346 thus can keep accuracy.

In one alternative, the drive gear 342 can be disconnected from the swivel bracket 54 and the driven gear 344 can be directly and rotatably connected to the swivel bracket 54. In another alternative, a forward end of the tilt pin boss 104 of the swivel bracket 54 can have teeth 352 on its outer periphery, or another member having such teeth can be coupled with the forward end of the tilt pin boss 104. In this structure, the drive gear 342 coupled with the tilt pin boss 104 is omitted.

With reference to FIGS. 38–43, another outboard motor 30A that has an anti-electrolytic corrosion structure is described below. Because the outboard motor 30A is similar to the outboard motor 30 except for the anti-electrolytic corrosion structure, the same members, components and devices described above are assigned with the same reference numerals and are not described repeatedly.

In general, the major part of the lower casing 50 is submerged when the outboard motor 30A is in operation. The splash may reach the upper casing 48 and the bracket assembly 34. Because the lower casing 50, the upper casing 48 and the bracket assembly 34 are basically made of aluminum alloy, those casings 48, 50 and the bracket assembly 34 can potentially be subject to electrolytic corrosion particularly if the surrounding water is salt water. One or more anode members preferably are attached to the lower or upper casings 48, 50 and/or the bracket assembly 34 for protecting the casings 48, 50 and the bracket assembly 34 from the electrolytic corrosion. In other words, the anode members can cause an effect of anti electrolytic corrosion. The casings 48, 50 and/or separate parts of the bracket assembly 34 can be electrically coupled with each other so that the remainder casing or parts that has no anode member also can take the anti electrolytic corrosion effect. This is because the electrically coupled casings or parts can keep the same electrical potential.

Figure 38:
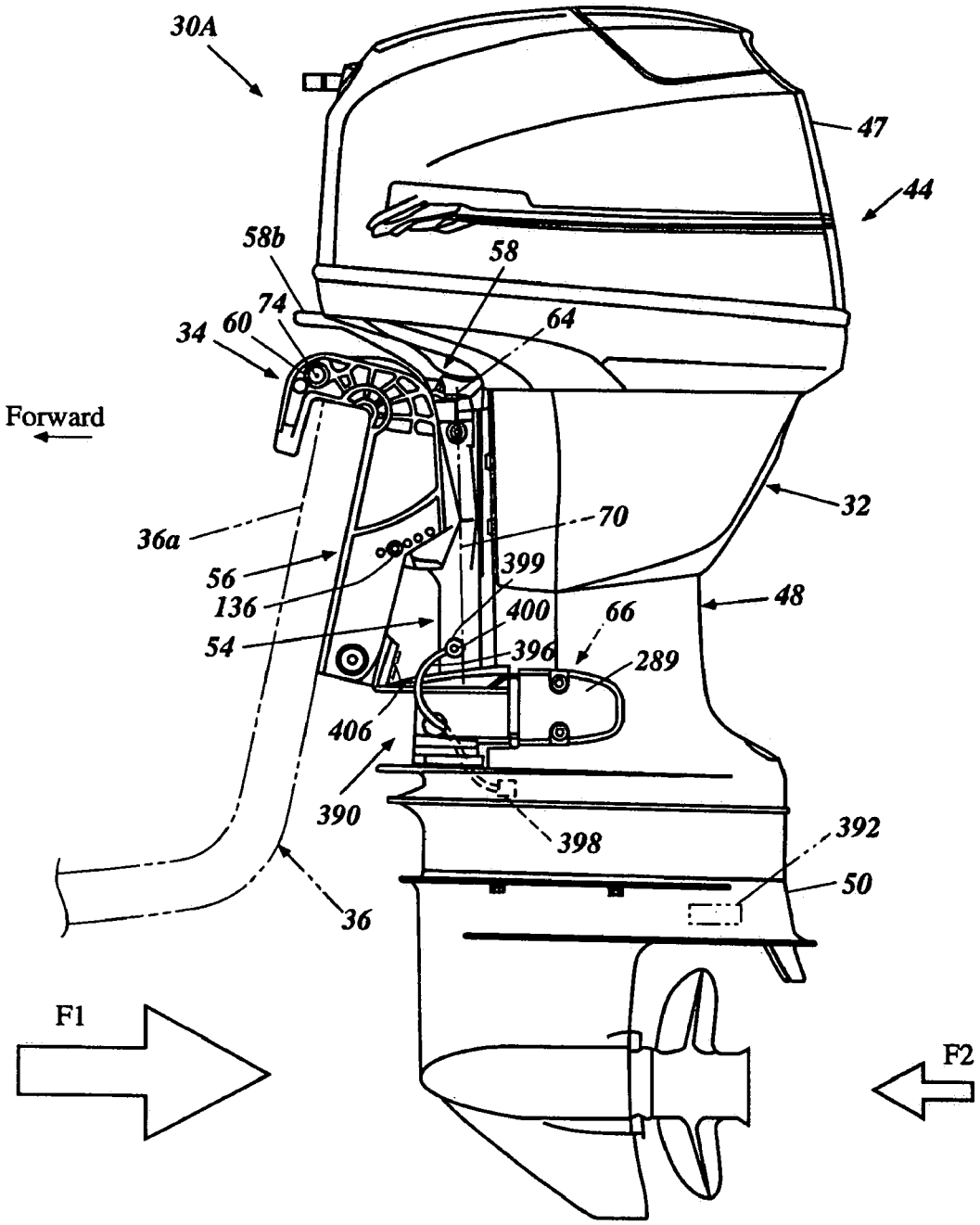
FIG. 38 illustrates a side elevation view of another outboard motor showing an anti-electrolytic corrosion structure.
Figure 39:
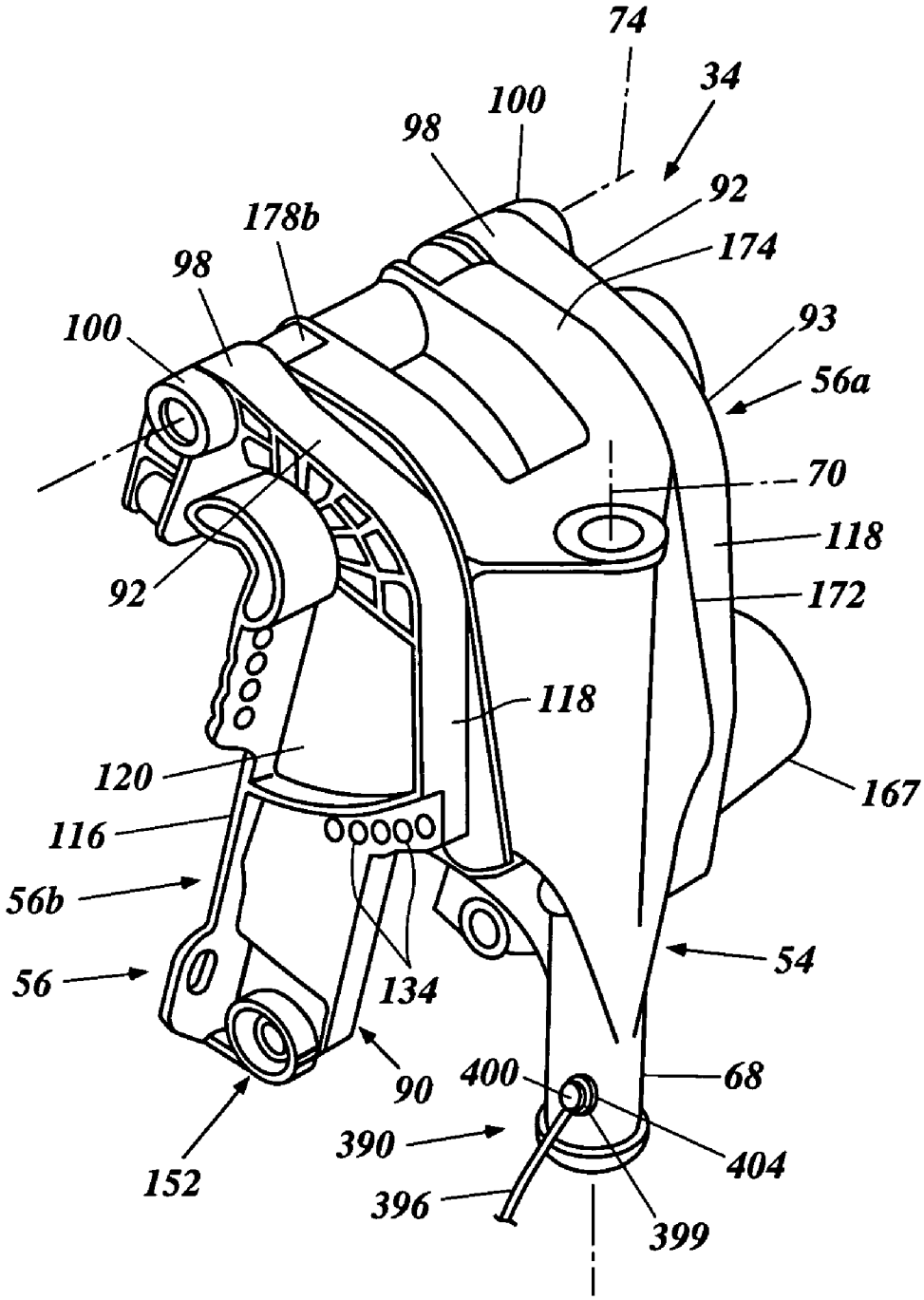
FIG. 39 illustrates a perspective view of a bracket assembly of the outboard motor of FIG. 38 also showing the anti-electrolytic corrosion structure.
Figure 40:
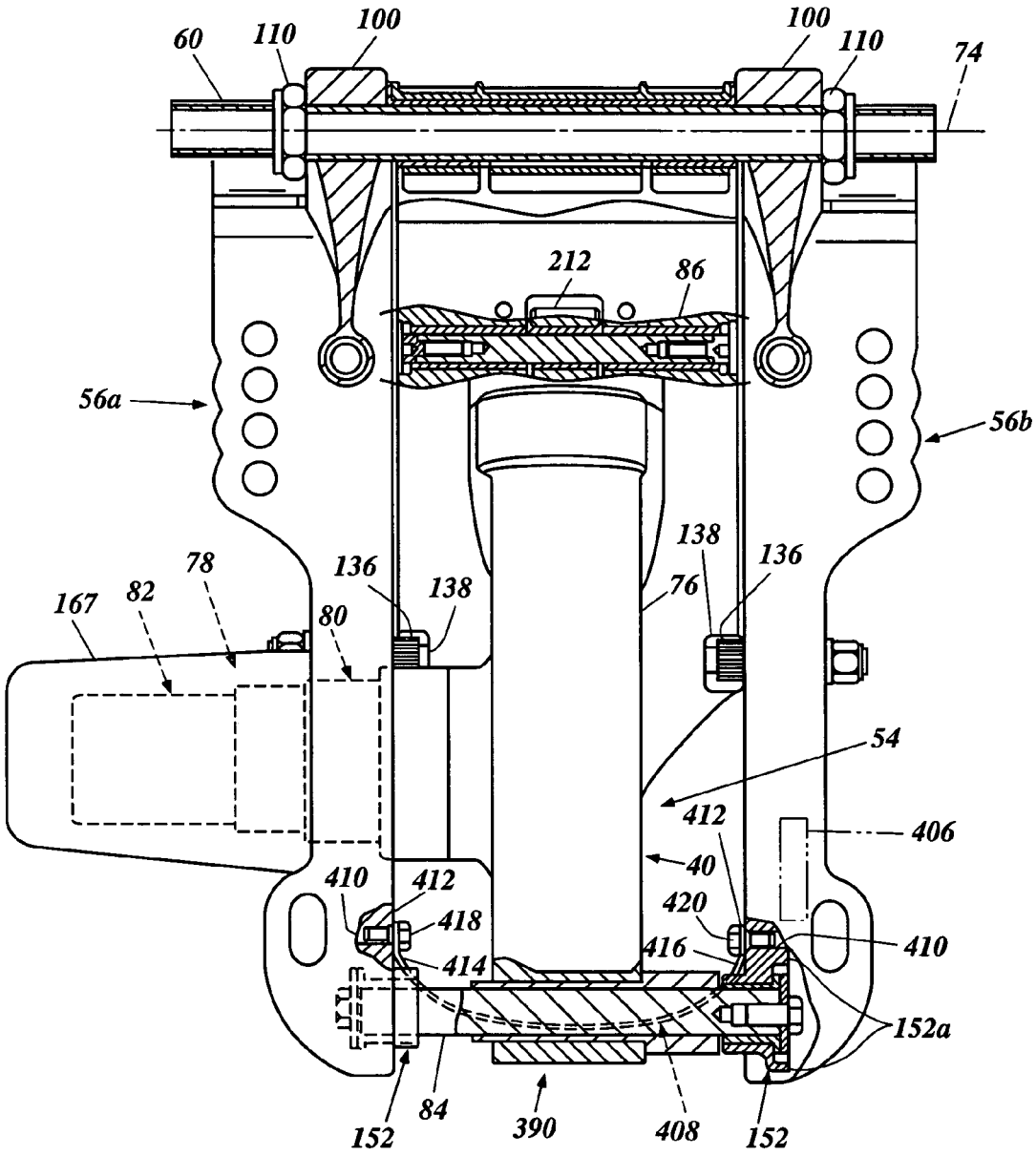
FIG. 40 illustrates a front elevation view of the bracket assembly further showing the anti-electrolytic corrosion structure.
Figure 41:
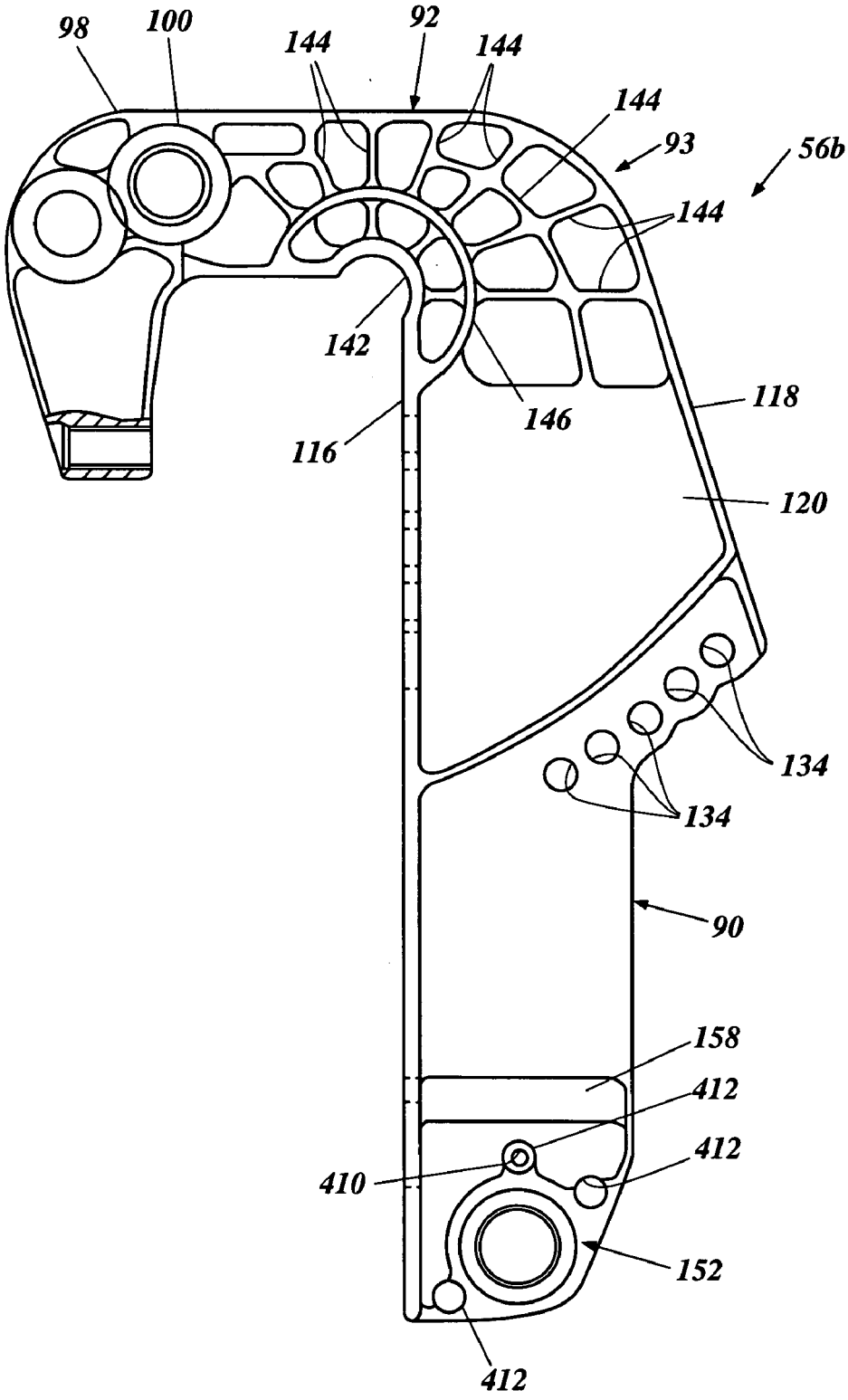
FIG. 41 illustrates a side elevation view (center side view) of a bracket arm of the bracket assembly disposed on the port side.
Figure 42:
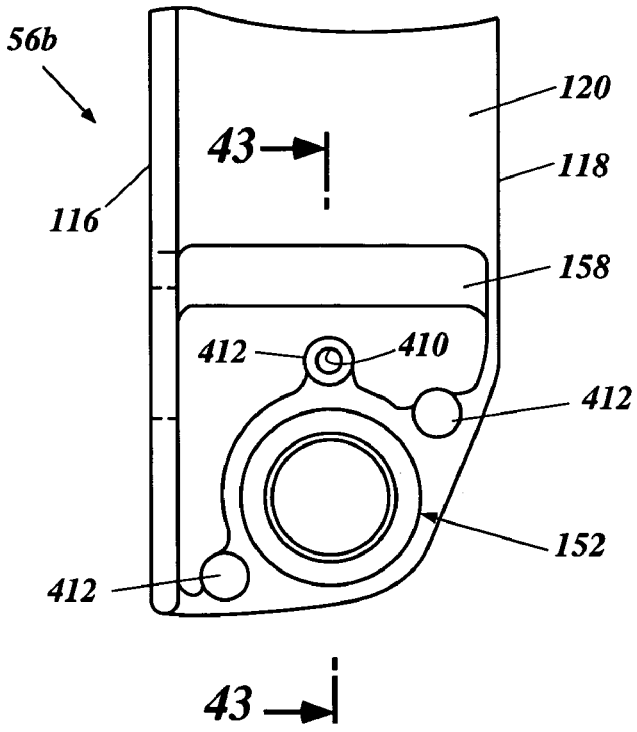
FIG. 42 illustrates an enlarged view of the bracket arm of FIG. 41.
Figure 43:
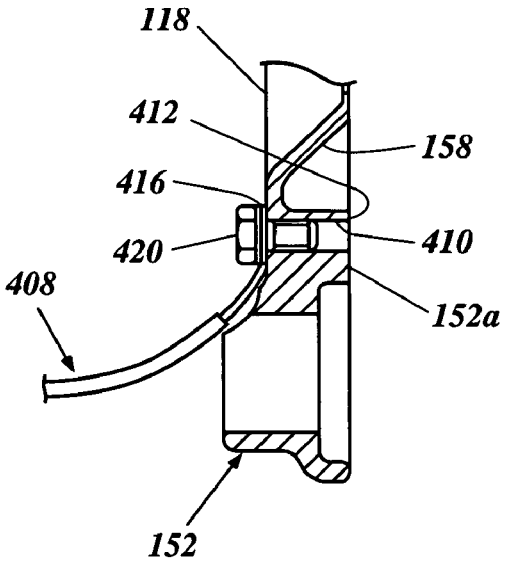
FIG. 43 illustrates a cross sectional view of the bracket arm taken along the line 43—43 of FIG. 42.

With reference to FIGS. 38 and 39, the lower casing 50 has an anode member 392 in the illustrated embodiment. More specifically, the anode member 392 is electrically and mechanically fixed to an inner side surface of the lower casing 50 located on the port side. The anode member 392 is preferably made of aluminum or zinc plate or sheet. The lower casing 50 thus is primarily protected from the electrolytic corrosion. There is no reason to exclude the upper casing 48 from members that can enjoy the anti electrolytic corrosion effect because the upper casing 48 is electrically coupled with the lower casing 50. That is, the upper casing 50 is also protected from the electrolytic corrosion by the anode member 392.

Preferably, an electric wire 396 connects the lower casing 50 and the swivel bracket 54 with each other. One terminal 398 of the electric wire 396 is electrically and mechanically fixed to the inner surface of the lower casing 50. A lower surface of the tubular section 68 of the swivel bracket 54 preferably has a bolt hole. Another terminal 399 of the wire 396 is fixed to the lower surface of the tubular section 68 by a bolt 400 that is screwed into the bolt hole. Because the swivel bracket 54 is electrically coupled with the lower casing 50 through the wire 396, the swivel bracket 54 is also protected from the electrolytic corrosion.

In the illustrated embodiment, the bolt hole is formed at a push-pin seat 404 that remains on the surface of the tubular section 68 after the vacuum die casting process has been done. That is, the swivel bracket 54 is produced in the vacuum die casting process as described above. A vacuum die casting machine typically has push-pins for pushing a product relative to the dies so as to remove the product from the dies. In the vacuum die casting process, one of the push-pins pushes the push-pin seat 404. Because of the purpose, the push-pin seat 404 inevitably has a large thickness than other portions around the push-pin seat 404. Thus, the swivel bracket 54 does not need to have a thicker portion for the bolt hole other than the push-pin seat 404. The swivel bracket 54 can be compact and light, accordingly.

With reference to FIGS. 38–43, the bracket arm 56*b* preferably has another anode member 406 that is electrically and mechanically fixed to a bottom end of the outer flange 118. The other bracket arm 56*a*, which has no anode member, is connected to the bracket arm 56*b* through an electric wire 408. Because the bracket arm 56*a* is electrically coupled with the bracket arm 56*b* through the wire 408, both of the bracket arms 56*a*, 56*b* are protected from the electrolytic corrosion.

In the illustrated embodiment, bolt holes 410 are formed at one of push-pin seats 412. That is, each bracket arm 56*a*, 56*b* has three push-pin seats 412 around the boss 152 that has high rigidity. The illustrated push-pin seats 412 are flushed with an outer surface 152*a* of the boss 152. Because the push-pin seats 412 are positioned adjacent to the boss 152, the push-pin seats 412 also have high rigidity. Each bolt hole 410 is formed at the seat 412 that is located in the highest position of those three seats 412. One terminal 414 of the wire 408 is affixed to the bracket arm 56*a* by a bolt 418 that is screwed into the bolt hole 410 of the bracket arm 56*a*, while another terminal 416 of the wire 408 is affixed to the bracket arm 56*b* by another bolt 420 that is screwed into the bolt hole 410 of the bracket arm 56*b*. The clamping bracket 56 thus can be compact and light similarly to the swivel bracket 54.

Other push-pin seats are formed at other portions of the respective bracket arms 56*a*, 56*b*. The bolt holes 410 can be made at one of the remainder push-pin seats 412 or other push-pin seats located at other portions of the bracket arms 56*a*, 56*b*. Because all the push-pin seats are available for forming the bolt holes without any particular conditions, precision is necessary for using the vacuum die casting process. This is because all the need for the anti corrosion structure 390 is to electrically connect separate components to keep them in the same electrical potential. Additionally, any conventional connectors and fasteners can be used other than the wires and bolts.

The push-pin seats can be effectively used to fix other members or components such as, for example, a cover to the swivel bracket or the clamping bracket. For example, if the pocket portion 167 is separately provided from the web 120 of the bracket arm 56*a* as a hydraulic unit cover and is affixed to the web 120, some of the push-pin seats can be used to form bolt holes or fixing bases for the hydraulic unit cover.

Although this invention has been disclosed in the context of a certain preferred embodiment, it will be understood by those skilled in the art that the present invention extends beyond the specifically disclosed embodiment to other alternative embodiments and/or uses of the invention and obvious modifications and equivalents thereof. It is also contemplated that various combinations or sub-combinations of the specific features and aspects of the embodiments may be made and still fall within the scope of the invention. It should be understood that various features and aspects of the disclosed embodiment can be combined with or substituted for one another in order to form varying modes of the disclosed invention. Thus, it is intended that the scope of the present invention herein disclosed should not be limited by the particular disclosed embodiment described above, but should be determined only by a fair reading of the claims.

What is claimed is:

1. An outboard motor comprising a drive unit, and a bracket assembly adapted to mount the drive unit on an associated watercraft, the bracket assembly comprising a swivel bracket carrying the drive unit for pivotal movement about a steering axis that extends generally vertically, and a clamping bracket supporting the swivel bracket and the drive unit for pivotal movement about a tilt axis that extends generally horizontally, either the swivel bracket or the clamping bracket, at least in part, comprising a first flange, a second flange spaced apart from the first flange, and a web extending between the first and second flanges to connect together the first and second flanges, the first and second flanges extending generally parallel to the tilt axis, and the web extending generally normal to the tilt axis, wherein each of the first and second flanges have a width between opposing side edges, and at least part of the web is spaced from both of the opposing edges.

2. An outboard motor comprising a drive unit, and a bracket assembly adapted to mount the drive unit on an associated watercraft, the bracket assembly comprising a swivel bracket carrying the drive unit for pivotal movement about a steering axis that extends generally vertically, and a clamping bracket supporting the swivel bracket and the drive unit for pivotal movement about a tilt axis that extends generally horizontally, at least part of the swivel bracket comprising a first flange, a second flange spaced apart from the first flange, and a web extending between the first and second flanges to connect together the first and second flanges, the first and second flanges extending generally parallel to the tilt axis, and the web extending generally normal to the tilt axis.

3. The outboard motor as set forth in claim 2, wherein the swivel bracket comprises a tubular section through which a steering shaft section extends, the steering shaft section defines the steering axis and is coupled with the drive unit, the first flange comprises a pair of side flange portions, and a center flange portion extends over the tubular section to connect the side flange portions.

4. The outboard motor as set forth in claim 3, wherein the clamping bracket has a tilt position regulating member, the first flange defines a pair of stopper sections for receiving the tilt position regulating member, and each one of the stopper sections is positioned in an area of each one of the side flange portions.

5. The outboard motor as set forth in claim 4, wherein said each one of the side flange portions and the center flange portion are connected with each other through a channel area that extends next to the stopper section.

6. The outboard motor as set forth in claim 3, wherein the swivel bracket comprises a tubular section through which a steering shaft section extends, the steering shaft section defines the steering axis and is coupled with the drive unit, and the second flange, at least in part, comprises portions extending from both sides of the tubular section.

7. The outboard motor as set forth in claim 2, wherein the swivel bracket comprises a tubular section through which a steering shaft section extends, the steering shaft section defines the steering axis and is coupled with the drive unit, a vertical section extending generally vertically along the tubular section, a horizontal section extending generally horizontally and pivotally coupled with the clamping bracket, and a merging section where the vertical and horizontal sections merge together, and at least the merging section has the first and second flanges and the web.

8. The outboard motor as set forth in claim 7, wherein the horizontal section comprises a pair of side portions extending generally on both sides of a hypothetical longitudinal center plane of the outboard motor, the plane includes the steering axis and extends normal to the tilt axis, and a tubular portion interposed between the side portions, and the side portions and the tubular portion pivotally supports a pivot pin which defines the tilt axis.

9. The outboard motor as set forth in claim 1, wherein the clamping bracket comprises a vertical section extending generally vertically, a horizontal section extending generally horizontally and pivotally coupled with the swivel bracket, and a merging section where the vertical and horizontal sections merge together, and at least the merging section has the first and second flanges and the web.

10. An outboard motor comprising a drive unit, and a bracket assembly adapted to mount the drive unit on an associated watercraft, the bracket assembly comprising a swivel bracket carrying the drive unit for pivotal movement about a steering axis that extends generally vertically, and a clamping bracket supporting the swivel bracket and the drive unit for pivotal movement about a tilt axis that extends generally horizontally, either the swivel bracket or the clamping bracket, at least in part, comprising a first flange, a second flange spaced apart from the first flange, a web extending between the first and second flanges to connect together the first and second flanges, and a plurality of ribs extending between the first and second flanges, the first and second flanges extending generally parallel to the tilt axis, and the web extending generally normal to the tilt axis.

11. The outboard motor as set forth in claim 10, wherein the clamping bracket comprises a vertical section extending generally vertically, a horizontal section extending generally horizontally and pivotally coupled with the swivel bracket, and a merging section where the vertical and horizontal sections merge together, and the ribs extend generally radiately from a corner where a top end line of the vertical section and a rear end line of the horizontal section intersect each other.

12. An outboard motor comprising a drive unit, and a bracket assembly adapted to mount the drive unit on an associated watercraft, the bracket assembly comprising a swivel bracket carrying the drive unit for pivotal movement about a steering axis that extends generally vertically, and a clamping bracket supporting the swivel bracket and the drive unit for pivotal movement about a tilt axis that extends generally horizontally, either the swivel bracket or the clamping bracket, at least in part, comprising a first flange, a second flange spaced apart from the first flange, a web extending between the first and second flanges to connect together the first and second flanges, and a third flange in an area between the first and second flanges, the first, second and third flanges extending generally parallel to the tilt axis, and the web extending generally normal to the tilt axis.

13. The outboard motor as set forth in claim 12, wherein the third flange is positioned closer to the first flange than to the second flange.

14. The outboard motor as set forth in claim 13, wherein the third flange generally extends along the first flange.

15. The outboard motor as set forth in claim 12, wherein the third flange extends between portions of the first flange.

16. An outboard motor comprising a drive unit, and a bracket assembly adapted to mount the drive unit on an associated watercraft, the bracket assembly comprising a swivel bracket carrying the drive unit for pivotal movement about a steering axis that extends generally vertically, and a clamping bracket supporting the swivel bracket and the drive unit for pivotal movement about a tilt axis that extends generally horizontally, either the swivel bracket or the clamping bracket, at least in part, comprising a first flange, a second flange spaced apart from the first flange, and a web extending between the first and second flanges to connect together the first and second flanges, the first and second flanges extending generally parallel to the tilt axis, and the web extending generally normal to the tilt axis, wherein at least a portion of the first flange is wider than a portion of the second flange corresponding to the portion of the first flange.

17. An outboard motor comprising a drive unit, and a bracket assembly adapted to mount the drive unit on an associated watercraft, the bracket assembly comprising a swivel bracket carrying the drive unit for pivotal movement about a steering axis that extends generally vertically, and a clamping bracket supporting the swivel bracket and the drive unit for pivotal movement about a tilt axis that extends generally horizontally, either the swivel bracket or the clamping bracket, at least in part, comprising a first flange, a second flange spaced apart from the first flange, and a web extending between the first and second flanges to connect together the first and second flanges, the first and second flanges extending generally parallel to the tilt axis, and the web extending generally normal to the tilt axis, the outboard motor additionally comprising a tilt mechanism to tilt the swivel bracket relative to the clamping bracket, a lower portion of the clamping bracket having a support section for supporting a lower portion of the tilt mechanism, the support section being positioned closer to a hypothetical longitudinal center plane of the outboard motor than the remainder of the clamping bracket, and the longitudinal center plane including the steering axis and extending normal to the tilt axis.

18. The outboard motor as set forth in claim 17, wherein at least a part of the web placed adjacent to the support section is positioned closer to the longitudinal center plane than the remainder of the web.

19. The outboard motor as set forth in claim 18, wherein the clamping bracket further has a tilt position regulating section disposed between top and bottom ends thereof, and at least the part of the web is positioned between the support section and the tilt position regulating section.

20. An outboard motor comprising a drive unit, and a bracket assembly adapted to mount the drive unit on an associated watercraft, the bracket assembly comprising a swivel bracket carrying the drive unit for pivotal movement about a steering axis that extends generally vertically, and a clamping bracket supporting the swivel bracket and the drive unit for pivotal movement about a tilt axis that extends generally horizontally, either the swivel bracket or the clamping bracket, at least in part, comprising a first flange, a second flange spaced apart from the first flange, and a web extending between the first and second flanges to connect together the first and second flanges, the first and second flanges extending generally parallel to the tilt axis, and the web extending generally normal to the tilt axis, wherein the clamping bracket has a tilted up position holding mechanism for holding the swivel bracket at a tilted up position, and the tilted up position holding mechanism is placed opposite to the steering axis relative to the tilt axis.

21. The outboard motor as set forth in claim 20, wherein the tilted up position holding mechanism comprises a stopper movable between a retracted position and an extended position, and the tilted up position holding mechanism holds the swivel bracket at the tilted up position when the tilted up position holding mechanism is in the extended position.

22. The outboard motor as set forth in claim 1, wherein the clamping bracket comprises a die cast structure that comprises a vertical section extending generally vertically, a horizontal section extending generally horizontally and pivotally coupled with the swivel bracket, and a merging section where the vertical and horizontal sections merge together, the die cast structure having a parting line formed between dies during die casting, wherein a first part of the parting line corresponding to the merging section is positioned farther from a hypothetical longitudinal center plane of the outboard motor than another part of the parting line corresponding to the vertical section, and the longitudinal center plane includes the steering axis and extends normal to the tilt axis.

23. An outboard motor comprising a drive unit, and a bracket assembly adapted to mount the drive unit on an associated watercraft, the bracket assembly comprising a swivel bracket carrying the drive unit for pivotal movement about a steering axis that extends generally vertically, and a clamping bracket supporting the swivel bracket and the drive unit for pivotal movement about a tilt axis that extends generally horizontally, either the swivel bracket or the clamping bracket, at least in part, comprising a first flange, a second flange spaced apart from the first flange, and a web extending between the first and second flanges to connect together the first and second flanges, the first and second flanges extending generally parallel to the tilt axis, and the web extending generally normal to the tilt axis, wherein a thickness of the inner flange is equal to or larger than a thickness of the outer flange.

24. A method for producing a swivel bracket or a clamping bracket of an outboard motor including a first flange and a second flange spaced apart from each other and a web extending between the first and second flanges, the method comprising placing first and second dies to define a cavity therebetween that corresponds to the shape of at least a portion of one of the swivel and clamping brackets, and introducing molten metal into the cavity under a negative pressure, the cavity shaped so that the clamping bracket or swivel bracket is formed to have a generally vertical section, a generally horizontal section, and a merging section in which the vertical and horizontal sections merge, wherein a parting line is formed on the bracket generally between the dies, and the dies are placed so that, when the swivel bracket is coupled with the horizontal section of the clamping bracket for pivotal movement about a tilt axis and an outboard motor is connected to the swivel bracket, a first part of the parting line corresponding to the merging section is positioned farther from a hypothetical longitudinal center plane of the outboard motor than another part of the parting line corresponding to the vertical section, and the longitudinal center plane extends normal to the tilt axis.

25. The outboard motor as set forth in claim 12, wherein each of the swivel bracket and clamping bracket have a generally vertically extending section and a generally horizontally extending section, and a merging section where the vertical and horizontal sections merge together, and at least the merging section has the first, second and third flanges and the web.

26. The outboard motor as set forth in claim 25, wherein in the merging section of the clamping bracket the first flange has a recessed portion, and wherein the third flange generally follows the curvature of the recessed portion.

27. The outboard motor as set forth in claim 16, wherein each of the first and second flanges have a width between opposing side edges, and at least part of the web is spaced from both of the opposing edges.

28. The outboard motor as set forth in claim 23, wherein each of the inner and outer flanges have a width between opposing side edges, and at least part of the web is spaced from both of the opposing edges.

29. The outboard motor as set forth in claim 28, wherein at least a portion of the inner flange has a different width than a portion of the outer flange corresponding to the portion of the inner flange.

30. The method as set forth in claim 24, wherein the dies are adapted to form a first flange, a second flange spaced apart from the first flange, and a web extending between the first and second flanges to connect together the first and second flanges.

* * * * *